US010668638B2

(12) United States Patent
Mayes

(10) Patent No.: US 10,668,638 B2
(45) **Date of Patent: *Jun. 2, 2020**

(54) DOUBLE HEADED KNIFE

(71) Applicant: Laura Jane Mayes, North Hollywood, CA (US)

(72) Inventor: Laura Jane Mayes, North Hollywood, CA (US)

(73) Assignee: EEZYCUT, LLC, Mooresville, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/240,990

(22) Filed: Jan. 7, 2019

(65) Prior Publication Data

US 2019/0176356 A1 Jun. 13, 2019

Related U.S. Application Data

(63) Continuation of application No. 14/937,867, filed on Nov. 10, 2015, now abandoned, and a continuation-in-part of application No. 12/806,927, filed on Aug. 23, 2010, now Pat. No. 9,346,177, and a continuation-in-part of application No. PCT/US2010/002293, filed on Aug. 20, 2010.

(60) Provisional application No. 62/077,893, filed on Nov. 10, 2014, provisional application No. 61/236,084, filed on Aug. 22, 2009, provisional application No. 61/236,084, filed on Aug. 22, 2009.

(51) Int. Cl.
*B26B 29/02* (2006.01)
*B26B 5/00* (2006.01)

(52) U.S. Cl.
CPC ..... *B26B 29/02* (2013.01); *B26B 5/00* (2013.01)

(58) Field of Classification Search
CPC ..... B26B 29/00; B26B 29/02; B26B 29/025; B26B 29/06; B26B 5/00; B26B 3/00; B26B 3/06
USPC ..... 30/151, 162, 280, 286–291
See application file for complete search history.

(56) References Cited

U.S. PATENT DOCUMENTS

| | | | |
|---|---|---|---|
| 1,553,449 | A | 9/1925 | Kennedy |
| 2,254,199 | A | 9/1941 | Baltuch |
| 2,471,334 | A | 5/1949 | Levin |
| 2,593,601 | A | 4/1952 | Pollak |

(Continued)

FOREIGN PATENT DOCUMENTS

| | | | |
|---|---|---|---|
| GB | 508438 | A | 6/1939 |
| GB | 896559 | A | 5/1962 |

(Continued)

OTHER PUBLICATIONS

Affidavit and supporting documents filed in U.S. Appl. No. 12/806,927, filed Nov. 29, 2013.

(Continued)

*Primary Examiner* — Phong H Nguyen
(74) *Attorney, Agent, or Firm* — Thompson Coburn LLP

(57) ABSTRACT

A knife has a first head and a second head. The first head has a first pair of arms and a first pair of knife edges. Each arm of the first pair of arms hangs over a different knife edge of the first pair of knife edges. Similarly, a second head has a second pair of arms and a second pair of knife edges. Each arm of the second pair of arms hangs over a different knife edge of the second pair of knife edges. The first head is connected to the second head.

11 Claims, 34 Drawing Sheets

(56) References Cited

U.S. PATENT DOCUMENTS

| | | | |
|---|---|---|---|
| 3,613,241 | A | 10/1971 | Allen |
| 4,134,206 | A | 1/1979 | Beermann |
| 4,620,369 | A | 11/1986 | Gercken |
| 5,046,253 | A | 9/1991 | Ireland |
| D362,168 | S | 9/1995 | Mancini |
| 5,561,905 | A | 10/1996 | Sherman |
| 5,590,471 | A | 1/1997 | Wiezenthal |
| 5,737,842 | A | 4/1998 | Freedman |
| 5,829,321 | A | 11/1998 | Domenico |
| D409,071 | S | 5/1999 | Reidenbach |
| 6,367,154 | B2 | 4/2002 | Degabli |
| 6,691,416 | B2 | 2/2004 | Yu Chen |
| D571,180 | S | 6/2008 | Marshall |
| 7,624,507 | B2 | 12/2009 | Bergstrand |
| D636,248 | S | 4/2011 | Still |
| D660,675 | S | 5/2012 | Gringer et al. |
| D714,611 | S | 10/2014 | Yu Chen |
| 2003/0131478 | A1 | 7/2003 | Feng |
| 2003/0213133 | A1 | 11/2003 | Hanna |
| 2004/0158992 | A1 | 8/2004 | Huang |
| 2005/0223564 | A1 | 10/2005 | Hanson |
| 2006/0288587 | A1 | 12/2006 | Ireland |
| 2007/0101592 | A1 | 5/2007 | Wen et al. |
| 2007/0245572 | A1* | 10/2007 | Ireland ..... B26B 5/005 30/294 |
| 2008/0040932 | A1 | 2/2008 | Gullicks et al. |
| 2010/0293796 | A1 | 11/2010 | Votolato |

FOREIGN PATENT DOCUMENTS

| | | | |
|---|---|---|---|
| GB | 2216835 | A | 10/1989 |
| GB | 2330323 | A | 4/1999 |
| JP | 3068094 | U | 2/2000 |

OTHER PUBLICATIONS

Affidavit filed in U.S. Appl. No. 12/806,927, filed Mar. 6, 2013.

European Patent Office Search Report of Application No. 10814054.2; dated May 27, 2013.

File history for Design U.S. Appl. No. 29/489,398, filed Apr. 29, 2014.

File history for Design U.S. Appl. No. 29/610,025, filed Jul. 7, 2017.

Title: EezyCut Trilobite Line Cutter, Date: Feb. 12, 2013, pp. 1-2, Publisher: Dive Right in Scuba, Location of Publisher: 24222 W. Lockport St, Plainfield, IL 60544, URL: http://www.diverightinscuba.com/knives-drisdivegear-eezycuttrilobitelinecutter-pri-3037.html, Comment: The URL no longer exists.

Title: EezyCut Trilobyte: Conquer your fear of ghost nets, Date: Oct. 30, 2011, pp. 1-4, Publisher: ScubaGadget—Scuba News Service, URL: http://www.google.com/url?sa=X&q=http://onespot.wsj.com/health/2011/10/30/6b335/eezycut-trilobyte-conquer-your-fear-of&ct=ga&cad=CAcQAhgBIAEoATAAOABA_dm79QRIAVgAYgV1bi1VUw&cd=tWrZhRSUJQA&usg=AFQjCNEIPF5H14vV6IN2eA3NonFb5APSqQ, Comment: The URL no longer exists.

Title: Scuba Diver Girls Cut Try Out the EezyCut Trilobite, Date: Oct. 3, 2011, pp. 3-6, Publisher: Scuba Diver Girls, Location of Publisher: 864 Grand Avenue #472, San Diego, CA 92109, URL: http://web.archive.org/ web/20111024170814/http://scubadivergirls.com/blog/?p=9356.

Title: Wet tested/ EezyCut, Date: Feb. 12, 2013, 2 pages, Publisher: Scuba Gear Reports, Location of Publisher: 4464 McGrath St. #118, Venture, CA 93003, URL: http://scubagearreports.com/index.php?option=com_content&view=article&id=325:whats-new-eezycut&catid=43&Itemid=27, Comment: The URL no longer exists.

International Search Report and Written Opinion for PCT/US2010/002293 dated May 31, 2011.

* cited by examiner

2000c

2290

DOUBLE HEADED KNIFE

CROSS-REFERENCE TO RELATED APPLICATIONS

This application is a continuation of application Ser. No. 14/937,867, filed Nov. 10, 2015, currently pending which (a) claims priority benefit of U.S. Provisional Patent Application No. 62/077,893, entitled "Double Headed Knife", filed Nov. 10, 2014; (b) is a continuation-in-part of U.S. patent application Ser. No. 12/806,927, entitled "Diver's Knife and Cutting Tool," filed Aug. 23, 2010, which is a continuation-in-part of Patent Cooperation Treaty Application Serial Number PCT/US10/02293, entitled "Diver's Knife and Cutting Tool," filed Aug. 20, 2010, which claims priority benefit of U.S. Provisional Patent Application No. 61/236,084, entitled "Fishbone Blade Cutting Tool", filed Aug. 22, 2009; and (c) is a continuation-in-part of U.S. patent application Ser. No. 29/489,398, entitled "Cutting Tool," filed Apr. 29, 2014, which is a continuation-in-part of U.S. patent application Ser. No. 12/806,927; all of the aforementioned applications are incorporated herein by reference.

FIELD

This specification generally relates to knives.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

In a variety of sports and other activities, there may be a need to cut rope and other lines quickly, without inadvertently cutting the user, the user's apparel or the wrong line. For example, if a parachute line gets tangled while parachuting, it may be desirable to cut one of the lines on the parachute, but cutting the wrong line or too many lines may make the parachute unusable. Similarly, if a diver gets tangled in lines while underwater, it may be desirable to cut those lines, but inadvertently cutting the diver's wet suit may create other unwanted and potentially fatal problems.

BRIEF DESCRIPTION OF THE FIGURES

In the following drawings like reference numbers are used to refer to like elements. Although the following figures depict various examples of the invention, the invention is not limited to the examples depicted in the figures.

FIG. 18A shows the top and FIG. 18B shows the bottom of the casing.

DETAILED DESCRIPTION

Figure 1A:
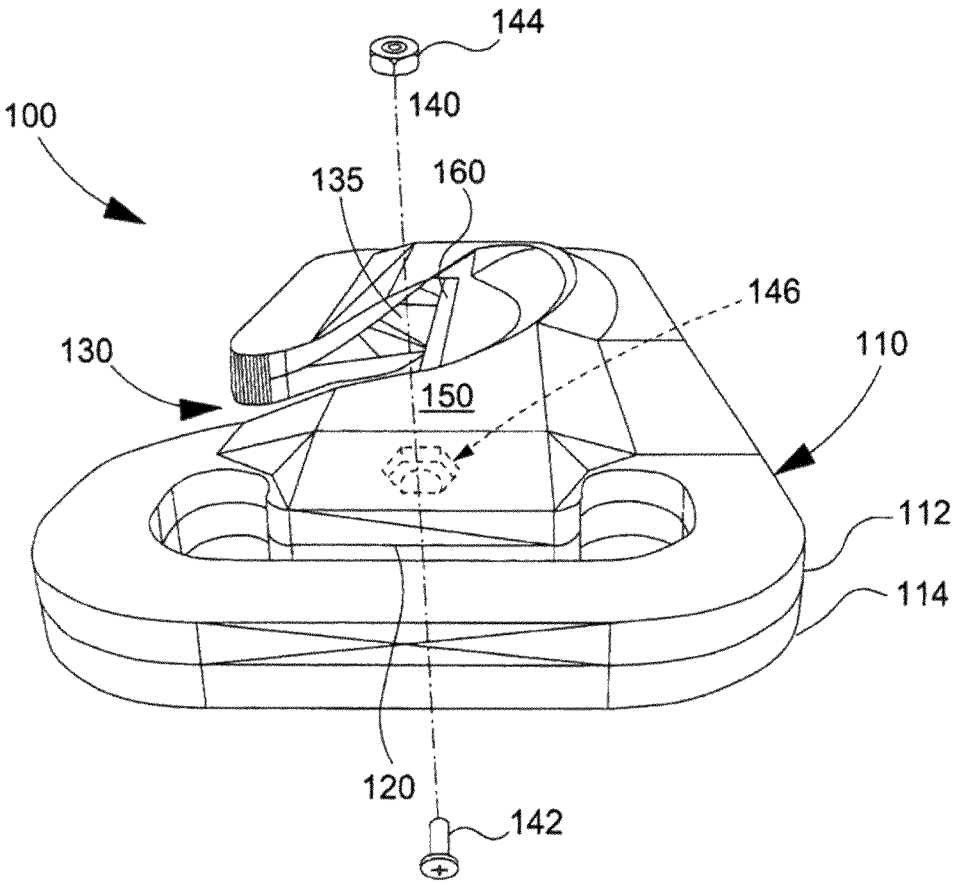
FIG. 1A shows an overhead front perspective view of an embodiment of a single-side knife.

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

In one embodiment, a relatively small cutting tool may be provided to be used by open water and overhead environment divers, surfers, firemen, rescue workers, as well as sky divers, para-gliders, fishermen, marine services personnel, arts and crafts operatives and for a normal household toolkit to be used by anyone who needs to cut rope, line, and/or string. In this specification, anywhere the term "line" appears, it is to be understood a generic to rope or string. Also, anywhere in the specification where the words line, rope, and string appear, the words line, rope, and string appear may be substituted with one another and/or with any material that the knife maybe used to cut to get different embodiments. At different places in the specification different lists of users and uses appear. Any of the embodiments in this specification may be used by any of the users and for any of the uses suggested by any of these lists, no matter where in the specification the list of users and uses appears. In this specification the word line is generic to cord, rope, string, packaging, and wires. In an embodiment, the knife includes an overhang and/or a directing edge that is located on the overhang opposite the blade and may have a convex shape that bulges inwards towards the knife blade directing the line towards the blade as the knife is pulled in a direction parallel to the edge of the blade. In an embodiment, the overhang includes a groove that is opposite the blade, which will tend to pinch, fold, or press the line as the knife is pulled in a direction parallel to the edge of the blade.

Any of the above embodiments may be used alone or together with one another in any combination. Inventions encompassed within this specification may also include embodiments that are only partially mentioned or alluded to or are not mentioned or alluded to at all in this brief summary or in the abstract.

In general, at the beginning of the discussion of each of FIGS. 1, 2 and 5-22 is a brief description of each element, which may have no more than the name of each of the elements in the one of FIGS. 1, 2 and 5-22 that is being discussed. After the brief description of each element, each element is further discussed in numerical order. In general, each of FIGS. 1-25 is discussed in numerical order and the elements within FIGS. 1-25 are also usually discussed in numerical order to facilitate easily locating the discussion of a particular element. Nonetheless, there is no one location where all of the information of any element of FIGS. 1-25 is necessarily located. Unique information about any particular element or any other aspect of any of FIGS. 1-25 may be found in, or implied by, any part of the specification.

In various places in discussing the drawings a range of letters, such as a-d are used to refer to individual elements of various series of elements that are the same. In each of these series, the ending letters are integer variables that can be any number. Unless indicated otherwise, the number of elements in each of these series is unrelated to the number of elements in others of these series. Specifically, even though one letter (e.g. "b") comes earlier in the alphabet than another letter (e.g., "c"), the order of these letters in the alphabet does not mean that the earlier letter represents a smaller number. The value of the earlier letter is unrelated to the later letter, and may represent a value that is greater the same or less than the later letter.

Single Sided Knife (Single Headed)

FIG. 1A shows an example of a top front perspective view of an embodiment of a knife 100. Knife 100 includes a casing 110. Casing 110 includes a top half 112 and a bottom half 114. Knife 100 also includes a handle 115 having handle slot 120, arm 125 forming slot 130, groove 135, a fastener 140 having a screw 142 with a nut 144, socket 146, an optional cover 150, and a blade 160. Other embodiments of single-side knife 100 may not have all of the components and/or may have other embodiments in addition to or instead of the components listed above.

Knife 100 is single sided, having only one blade on only one side of knife 100 that is exposed. Top half 112 and bottom half 114 are sandwiched together and secured in place by a fastener, such as screw, bolt, rivet, clasp of other fastener. Casing 110 may be made of any plastic polymeric material. In alternative embodiments, casing 110 may be made of other materials, such as other plastics, wood, metals, or ceramics. Any place is the specification where plastic is mentioned, Keplar®, wood, ceramic, or another material may be substituted. Arm 125 overhangs the blade, directs the line into the blade, and helps protect a user from inadvertently cutting themselves or the wrong line with the blade. Handle slot 120 is located at the bottom of casing 110 for a user to grasp knife 100. Handle slot 120 is also designed to receive an attachment strap (not shown) to attach knife 100 to a user. Arm 125 is an overhang that protects the user from the blade. Slot 130 is provided on only one side of casing 110 and receives any line that is to be cut. Slot 130 and additional features are described in FIG. 1B and FIG. 1C. Optionally, slot 130 may be shaped to act as a bottle opener. Groove 135 is opposite the cutting blade, and shields the cutting blade from accidently coming in contact with objects and part of the body. Groove 135 is a hollowed out portion of arm 125 or the overhang. Line being cut will tend to pinch, fold, or press as a result of the cutting blade pushing the line into the groove 135.

Fastener 140 holds top half 112 of casing 110 and bottom half 114 of casing 110 together. In an embodiment, screw 142 and nut 144 are made from 316ss grade stainless steel, or another corrosion resistant alloy that can withstand prolonged exposure to salt and water without corroding. In an embodiment nut 144 is hexagonally shaped. In an alternative embodiment, screw 142 has a hexagonal shaped head. However, in another embodiment screw 142 and/or nut 144 can be made of another material, such as a strong and durable plastic or another grade of metal. Socket 146 is noncircular and mates with nut 144, so that screw 142 may be screwed into nut 144 while socket 146 prevents nut 144 from turning. Optional cover 150 is placed over fastener 140 to cover and protect fastener 140. Socket 146 is drawn in phantom, because socket 146 is hidden from view by optional cover 150. Once nut 144 is placed in socket 146, optional cover 150 (if present) hides nut 144 from view. There may be a similar cover covering each of the socket for screws and nuts of each the embodiments of the knives in this specification. Blade 160 is held between top cover 112 and bottom cover 114 and secured in place by fastener 140 just off the edge of slot 130. Blade 160 is exposed to cut the line. In an embodiment, blade 160 is replaceable and is made of passivated 440*a* stainless steel with a silicone coating for marine use and ordinary carbon steel for non-marine use. In an embodiment, blade 160 may be a razor blade.

Figure 1B:
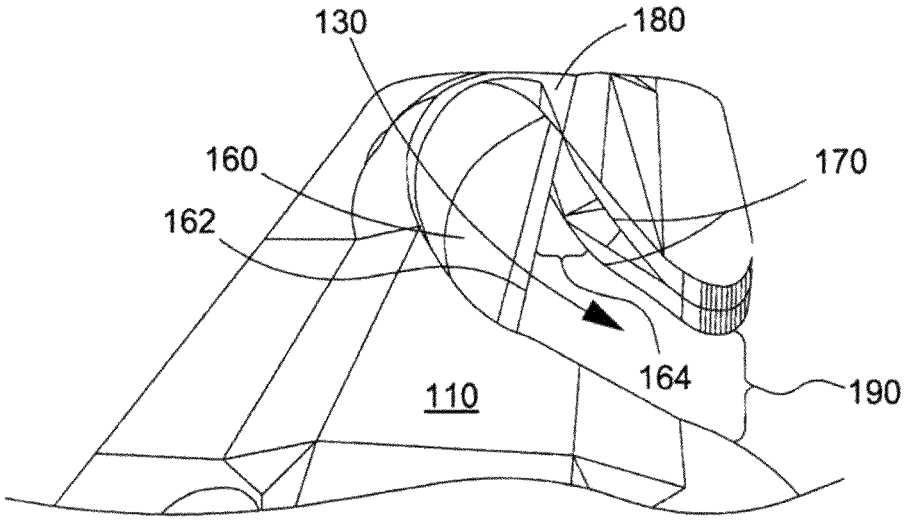
FIG. 1B shows a partial overhead front perspective view of an embodiment of a slot of a single-side knife.

FIG. 1B shows a front overhead perspective view of an embodiment of a slot 130 of the knife 100. Slot 130 includes a cutting edge 162 (of the blade 160), a distance 164 to a directing edge 170, an overhang 180 of arm 125, and an opening 190 to the blade. Other embodiments of slot 130 may not have all of the components and/or may have other embodiments in addition to or instead of the components listed above.

Cutting edge 162 of the blade 160 cuts line that is run or drawn along directing edge 170, which pushes the line against cutting edge 162 (of the blade 160). Distance 164 between the convex edge and the blade is relatively small and helps prevent a user from cutting their fingers on blade 160. Distance 164 decreases in the direction moving towards one end of the blade 160. Directing edge 170 is angled with respect to cutting edge 162 so as to force or push the line or rope onto cutting edge 162 of the blade 160 as distance 164 decreases, which facilitates cutting the line. The cutting action is relatively cleaner, more precise, and easier to cut as a result of the directing edge 170 pushing the line onto cutting edge 162. Overhang 180, which is the portion of arm 125 that overhangs blade 162, is disposed over an end of cutting edge 162 of the blade 160 to help prevent the user from cutting their finger while using knife 100. Opening 190 is disposed alongside of casing 110 and is also relatively small to help prevent the user from cutting their finger while using knife 100. Opening 190 also receives any line or string to be run and cut along cutting edge 162 of the blade 160 by knife 100. Although in the current embodiment, opening 190 is in the middle of knife 100, in other embodiments, opening 190 may be at the front of knife 100.

Figure 1C:
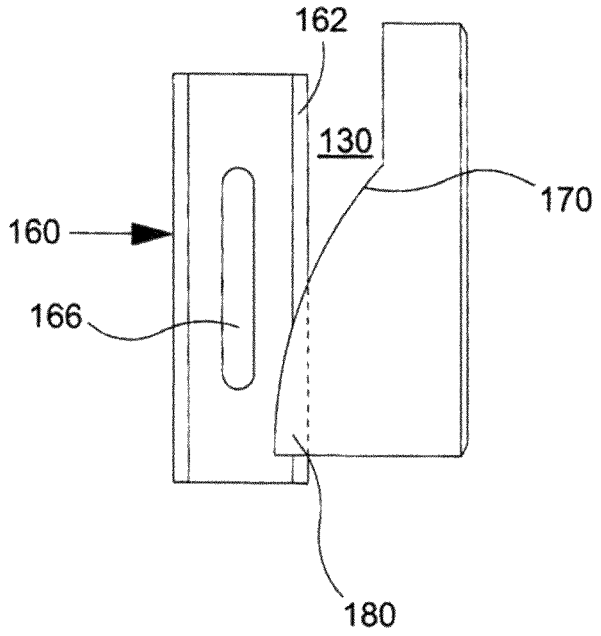
FIG. 1C shows a side perspective view of an embodiment of a cutting blade and a directing edge of a single-sided knife.

FIG. 1C shows a representation of an embodiment of a blade 160 and a directing edge 170 of knife 100. Blade 160 and directing edge 170 include cutting edge 162 of the blade 160, a blade aperture 166, and overhang 180. Other embodiments of blade 160 and a directing edge 170 of knife 100 may not have all of the components and/or may have other embodiments in addition to or instead of the components listed above.

FIG. 1C shows the relative orientation of blade 160 with respect to directing edge 170. As knife 100 is pulled, the line will run along directing edge 170 and be pushed onto cutting edge 162 for a relatively cleaner, more precise and stronger cut, as described in FIG. 1B. Overhang 180 is disposed over an end of cutting edge 162 of the blade 160 to help prevent user from cutting their finger while using single-side knife 100 and to guide the rope or line onto blade 160, as described in FIG. 1B. Blade aperture 166 is placed on one or more posts that protrude through and hold blade 160 in place when knife 100 is assembled. In an embodiment, screw 142 passes through aperture 166 (either passing directly through aperture 166 or passing through aperture 166, while blade 160 is set between top cover 112 and bottom cover 114 of the casing to secure blade 160 in a fixed position, which, in an embodiment, is away from center of casing 110 towards inner grove 130.

Figure 1D:
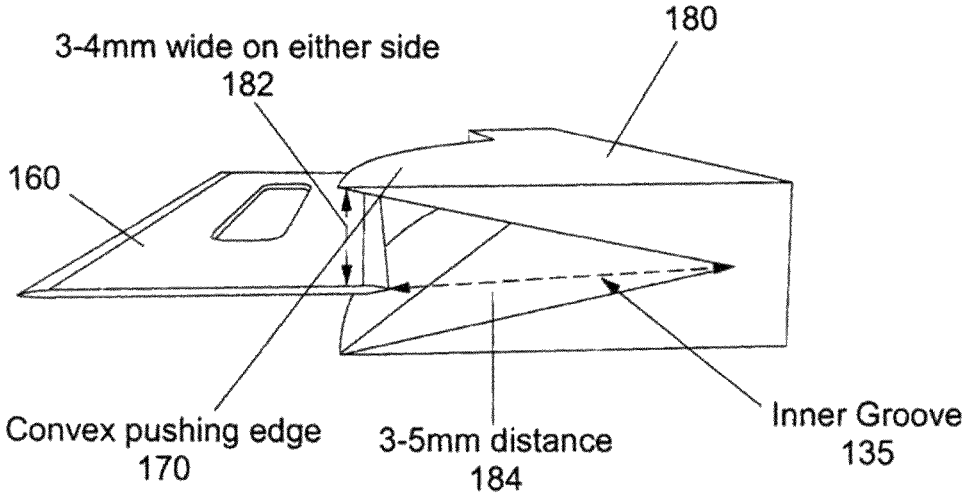
FIG. 1D shows the location of the blade with respect to the overhang.

FIG. 1D shows the location of the blade with respect to the overhang. FIG. 1D shows groove 135, blade 160, overhand 180, distance 182, and 184. In other embodiments, the view illustrated in FIG. 1D may not have all of the features and/or may have other embodiments in addition to or instead of the features listed above.

Groove 135 was discussed in conjunction with FIG. 1A. Blade 160 and overhand 180 were discussed above in conjunction with FIGS. 1A-C. Distance 182 is the distance from the top flat surface of blade 160 to the top of the face of knife 100, which may be 3 to 4 mm, for example. Distance 182 is the distance from the cutting edge of blade 160 to the apex of groove 135 (which may also be referred to as the inner groove).

Double Sided Knife (Single Headed)

Figure 2A:
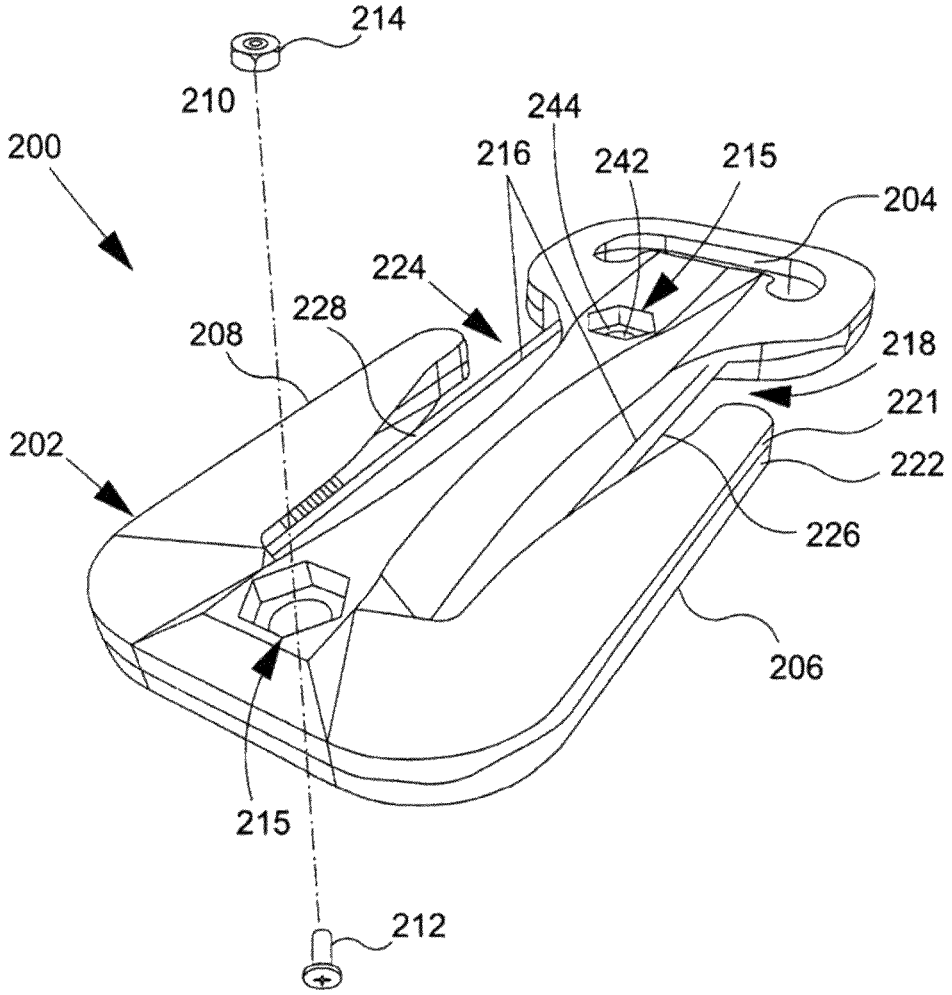
FIG. 2A shows a side overhead perspective view of an embodiment of a double-sided knife.

FIG. 2A shows a side overhead perspective view of an embodiment of a knife 200. Knife 200 includes a casing 202, a handle slot 204, side 206, side 208, fastener 210 having screws 212 with nuts 214, a blade 216, first slot 218, bottom half 221, top half 222, second slot 224, first cutting blade 226, second cutting blade 228, and hole 242. Other embodiments of knife 200 may not have all of the components and/or may have other embodiments in addition to or instead of the components listed above.

In an embodiment, the knife 200 is a relatively small cutting tool used by open water and overhead environment divers, surfers, as well as sky divers, para-gliders, fishermen, marine services personnel, rock climbers, fire and rescue, kite surfers on the water, arts and crafts operatives and in a normal household toolkit by anyone who needs to cut the line.

The knife 200 has two exposed edges on either side available for cutting. The knife 200 is double-sided, so it can be used to cut from either side, which can be useful in an emergency. Knife 200 is essentially the same as knife 100 except that knife 200 has two blades exposed, and each blade has its own overhang and surface for pushing the line into the corresponding blade as knife 200 is pulled, whereas in contrast knife 100 only has one blade exposed. In general any feature of knife 100 may be incorporated in knife 200 and any feature of knife 200 may be incorporated in knife 100. Similarly, for any embodiment of knife 100 there is a corresponding embodiment of knife 200 and for any embodiment of knife 200 there is a corresponding embodiment of knife 100.

The description of casing 110, top half 112, bottom half 114, handle slot 120, slot 130, fastener 140, screw 142, nut 144, socket 146, blade 160, and cutting edge 162 have essentially the same description as casing 202, top half 221, bottom half 222, a handle 204, first slot 218, second slot 224, fasteners 210, screws 212, nuts 214, socket 215, first cutting blade 226, and second cutting blade 228, respectively, except that there is only one slot 130 that corresponds to blade 216, both first slot 230 and second slot 235. Also there is only one fastener 140 that corresponds to two fasteners 210, one screw 142 that corresponds to two screws 212, and one nut 144 that corresponds to two nuts 214, and one socket 146 corresponds to two sockets 215.

Casing 202 has a top cover and a bottom cover that are attached together, via fasteners. In an embodiment, casing 202 is made of any plastic polymeric material, wood, or Keplar®, other material. Handle slot 204 is located at the bottom of casing 202 for a user to grasp knife 200. Handle slot 204 is designed to receive an attachment strap (not shown) to attach knife 200 to a user. Sides 206 and 208 are two different sides of knife 200, both of which may be used for cutting the line. Sides 206 and 208 are also the sides of arms or overhangs that overhang the cutting edges of the blade protecting against accidentally cutting an object.

Screws 212 and nuts 214 hold casing 202 together. First slot 235 and second slot 230 can receive any line that is to be cut. Fastener 210 may include a plurality of 316ss grade stainless steel screws 212 with nuts 214, which may both be made of a corrosion resistant alloy that withstands exposure to salt and water. However fastener 210 can be any grade of metal.

Blade 216 is double-sided. Blade 216 is replaceable and is made of passivated 440*a* stainless steel with a silicone coating for marine use and ordinary carbon steel for non-marine use. First slot 218 will be discussed below in conjunction with second slot 224.

Top cover 221 is the top half of casing 202, and bottom cover 222 is the bottom half of casing 202. Top cover 221 and Bottom cover 222 detach form one another by removing the screws 212 and 214. Blade 216 is held between top cover 221 and bottom cover 222 of the casing and secured in place by fastener 210.

First slot 218 is provided on one side 206 of the casing and second slot 224 is provided on side 208 (the other side) of the casing. Blade 216 is exposed within first slot 218 and second slot 224 for cutting the line as desired by user. Additional features of first slot 218 and second slot 224 are described in FIG. 2B and FIG. 2C. Hole 242 allows screw 212 to pass through to secure to nut 214.

The knives 100 and 200 can be used by divers and other users of line cutting tools and is relatively small, double-sided, does not have a large open blade (which is a safety feature) and can cut the line up to 14 mm (0.55 inches) wide, can cut the line from either side and can be reused by throwing away the old blade and replacing it with a standard sized new carpet blade after the blade wears out. In other embodiments, wider lines can be cut by using a larger version of the knives 100 and 200. Since the blade 160 or 216 is not exposed, the likelihood of cutting oneself or cutting something unintentionally is reduced.

Figure 2B:
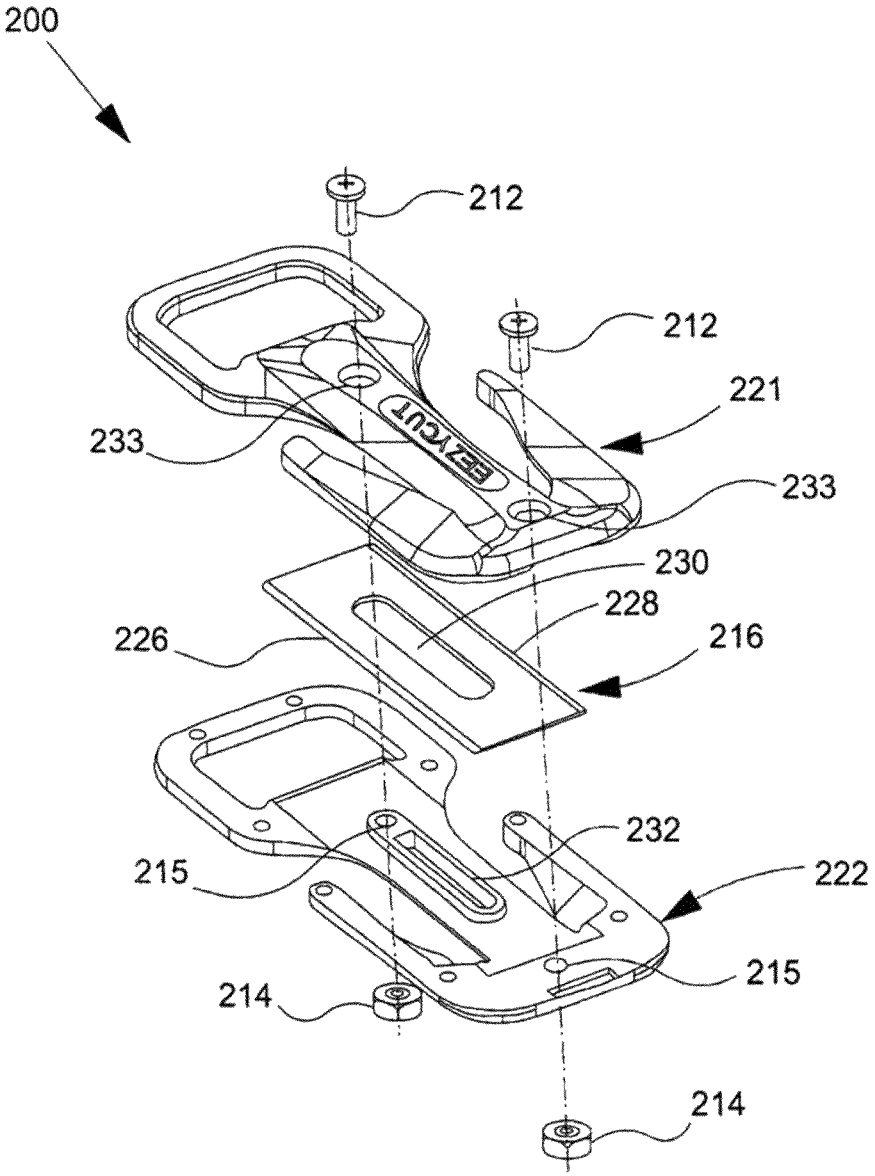
FIG. 2B shows an exploded, side, overhead, perspective view of an embodiment of a double-sided knife.

FIG. 2B shows an exploded side overhead perspective view of an embodiment of a knife 200. Knife 200 includes top half 221 of the casing, bottom half 222 of the casing, screws 212, screw apertures 214, nuts 214, blade 216, a first cutting edge 226, a second cutting edge 228, a slotted aperture 230, and a raised fitting 232 for the slotted aperture, and socket 233. Other embodiments of double-sides knife 200 may not have all of the components and/or may have other embodiments in addition to or instead of the components listed above.

Top half 221 of the casing, bottom half 222 of the casing, screws 212, nuts 214, socket 215, blade 216, first cutting edge 226, second cutting edge 228 and a slotted and aperture 230 have essentially the same description as top half 112, bottom half 114, screw 142, nut 144, socket 146, blade 160, cutting edge 162, aperture 166, which were described above in conjunction with FIGS. 1A-1C. However, although there is only one of each of screw 142, nut 144, and cutting edge 162, there are two of each of screws 212 and nuts 214, socket 215, and the first cutting edge 226 and the second cutting edge 228 correspond to cutting edge 162.

Top cover 221 of the casing and bottom cover 222 of casing are set between blade 216 to form casing 202. Top cover 221 of casing and bottom cover 222 of casing also have sockets 215 to accommodate screws 212 that are extended through screw apertures 242. Nuts 214 are placed on ends of screws 212 to secure screws 212, top cover 221 of the casing, bottom cover 222 of the casing and blade 216 together. First cutting edge 226 is exposed in first slot 235 on one side of knife 200 to cut the line. Second cutting edge 228 is exposed in second slot 230 on other side of the diver's knife to cut the line. Slotted aperture 230 is provided to accommodate screw 212 if necessary. Raised fitting 232 is provided to accommodate slotted aperture 230 and hold blade 216 in place. Sockets 233 receive screws 212. The heads of screws 212 rest in sockets 233. Raised fitting 232 is a protrusion sitting within a rectangular shaped well or depression. Blade 216 sits in the well or depression, while aperture 230 mates with raised fitting 232.

Figure 2C:
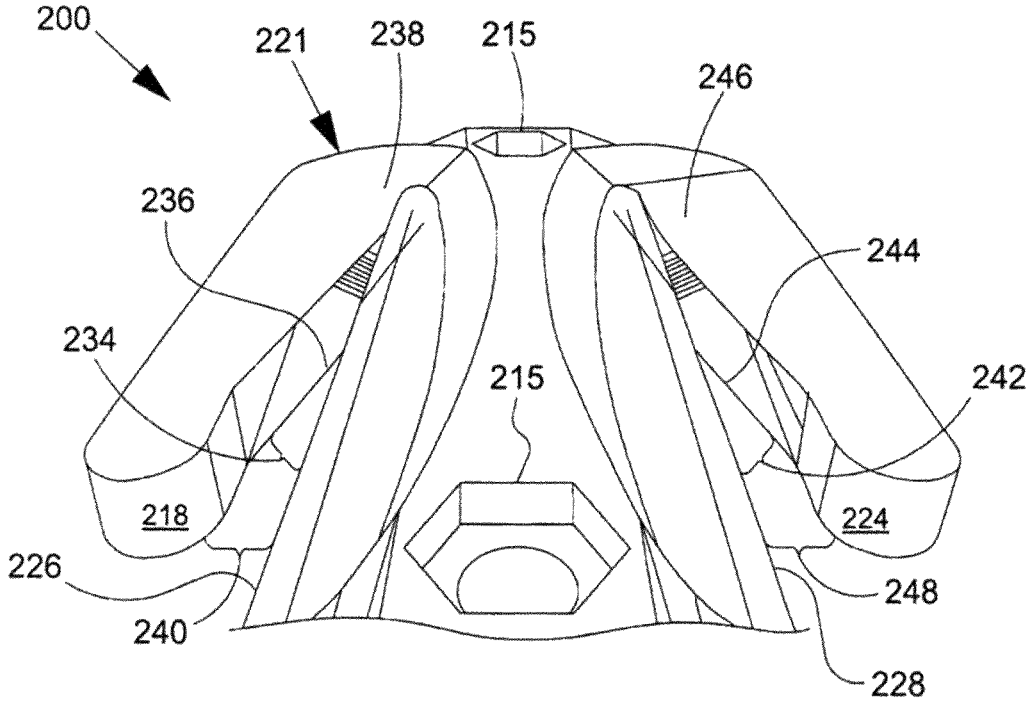
FIG. 2C shows an overhead front perspective view of an embodiment of slots of a double-sided knife.

FIG. 2C shows an overhead perspective view of an embodiment of first slot 218 and second slot 224 of the knife 200. Knife 200 includes first slot 218, second slot 224, first cutting edge 226, second cutting edge 228, a first distance 234, a first directing edge 236, a first overhang 238 of the first convex edge and a first opening 240 to the cutting blade, a second distance 242 between the second directing edge and the second cutting blade, a second directing edge 244, a second overhang 246 of the second directing edge and a second opening 248. Other embodiments of first slot 218 and second slot 224 of the knife 200 may not have all of the components and/or may have other embodiments in addition to or instead of the components listed above.

First slot 218 and second slot 224 correspond to slot 130, first cutting edge 226 and second cutting edge 228 correspond to cutting edge 162, first distance 234 and second distance 242 correspond to distance 164, first directing edge 236 correspond to directing edge 170, a first overhang 238 and second overhang 246 correspond to overhang 180, of the first convex edge 236 and a first opening 240 to the cutting blade, a second distance 242 between the second directing edge 244 and the second cutting blade, a second directing edge 244, a second overhang 246 of the second directing edge and a second opening 248. Slot 130 includes a cutting edge 162 of the blade 160, a distance 164 between the convex edge and the blade 160, a directing edge 170, an overhang 180 of the directing edge and an opening 190 to the blade 160.

Figure 2D:
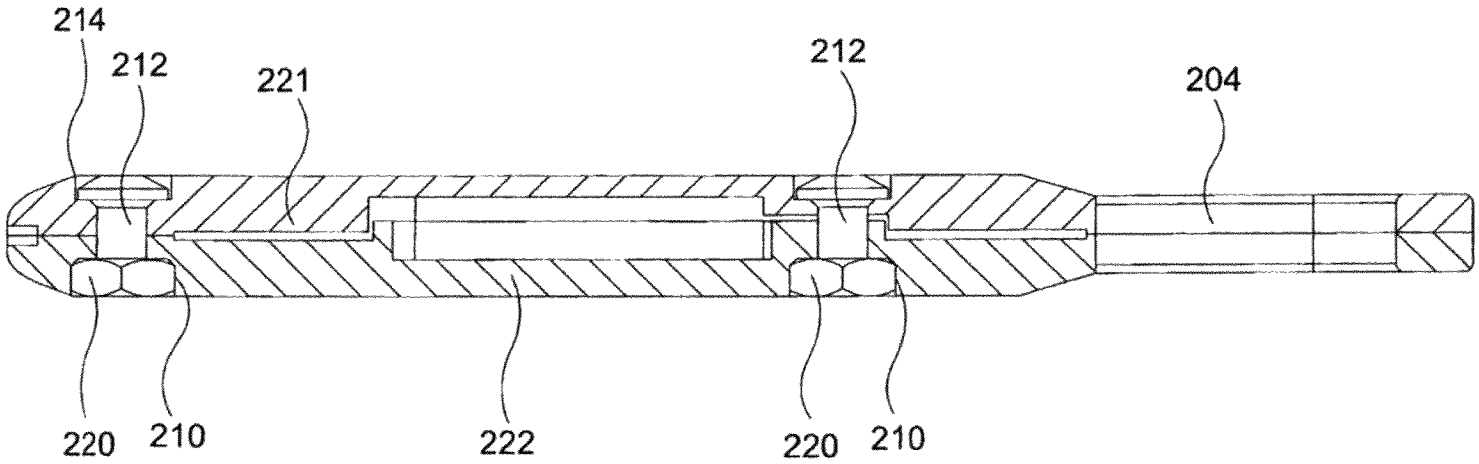
FIG. 2D shows a cross-sectional side perspective view along line 2D-2D from FIG. 2A of a double-sided knife.

FIG. 2D shows a cross-sectional side perspective view along line 2D-2D from FIG. 2A of knife 200. Knife 200 includes casing 202, handle slot 204, fastener 210, screws 212, screw sockets 214, top half 221 and bottom half 222. Other embodiments of knife 200 may not have all of the components and/or may have other embodiments in addition to or instead of the components listed above.

Casing 202, handle slot 204, fastener 210, screws 212 and nuts 214 details are described in FIG. 2A description. Screw sockets 214 receive screws 212 and allow nuts 214 to secure screws 212 with screw sockets 214. Top half 221 and bottom half 222 details are described in FIG. 2B. Additional screw socket 214 is also provided adjacent to slotted aperture 230.

Figure 2E:
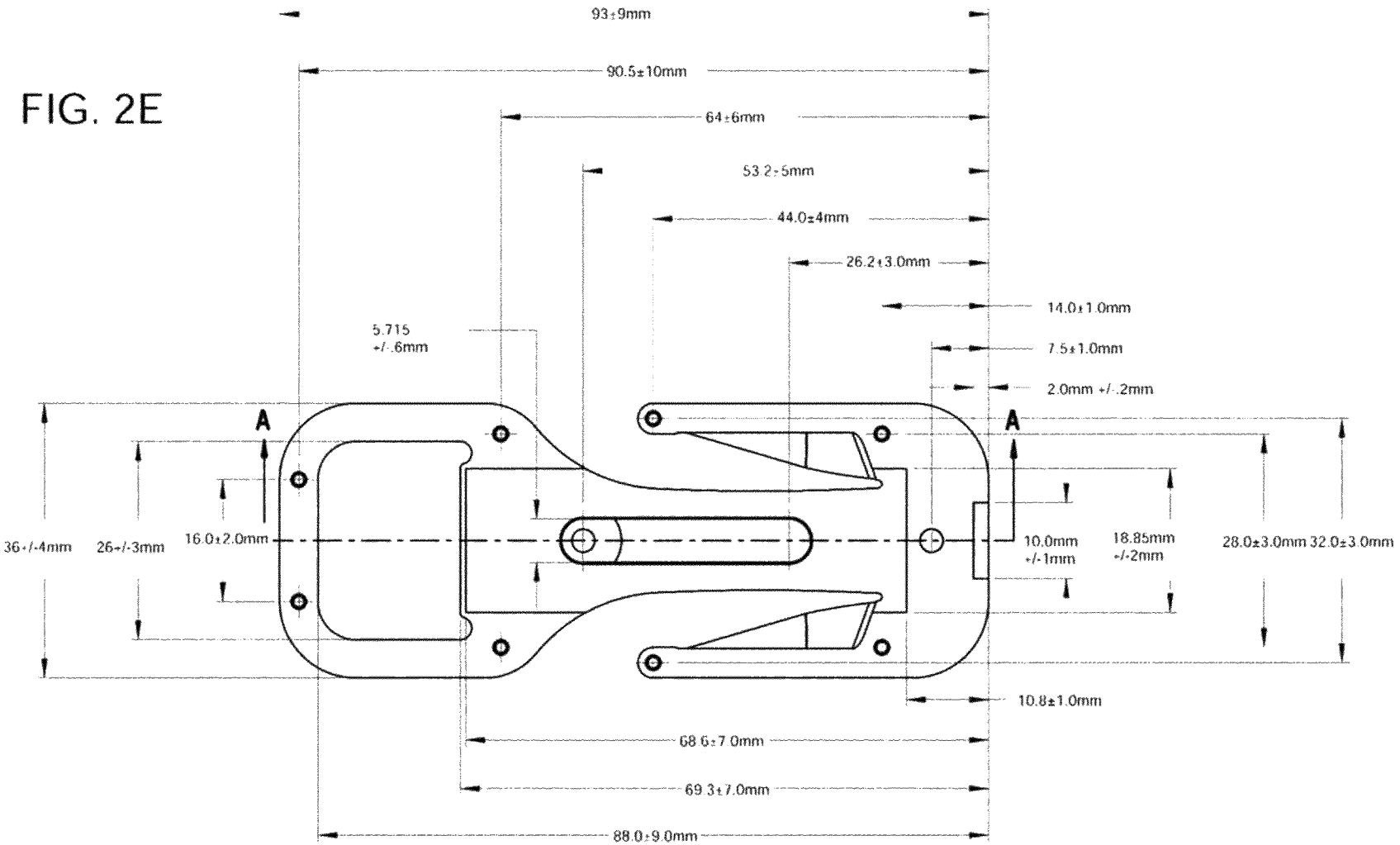
FIG. 2E shows the inner surface of the top half of the casing of FIG. 2D, and the dimension of an embodiment of the knife.
Figure 2F:
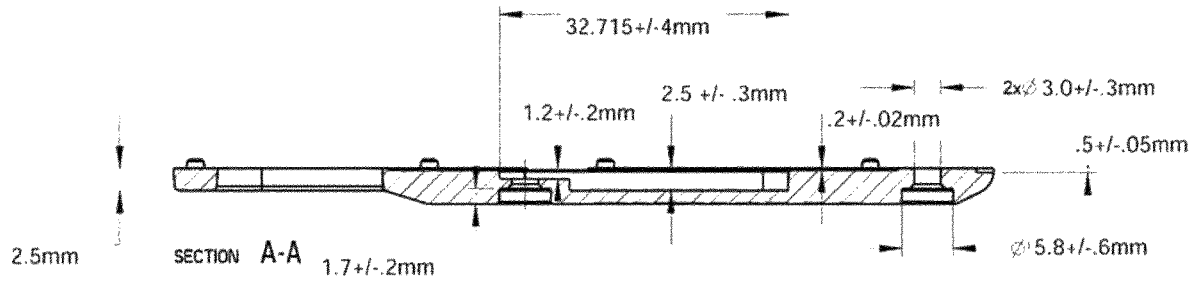
FIG. 2F shows a cross section of the bottom half of the casing of FIG. 2D, and the dimension of an embodiment of the knife.

FIG. 2E shows the inner surface of the top half of the casing of FIG. 2D, and the dimension of an embodiment of the knife FIG. 2F shows a cross section of the bottom half of the casing of FIG. 2D, and the dimension of an embodiment of the knife. The dimension of the top half and bottom half of the knife are similar to one another. In FIGS. 2E and 2F, each dimension is followed by a "+/−" and a value. The value following the +/−, when added and subtracted to the value of the dimension, indicates a range of different embodiments of that dimension for knife 200. FIGS. 2E and 2F are only examples of embodiments of the top and bottom halves of the casing. The specific dimensions given in the specification are only examples. Other combinations of dimensions of the top and bottom halves of the casing may also be used. In general the dimension within this specification may be varied within 5%, 10%, or 50% of those given to obtain other embodiments, and in yet more embodiments, the sizes may be varied by even greater amounts to obtain other embodiments. However, the larger the opening to the blade, the less effective the overhang will be in protecting against accidentally cutting an object.

More Discussion about the Single and Double Sided Knife and Dimensions

In an embodiment, the knives 100 and 200 is stored on a user's wrist, making it easy to access, minimizing the amount of time a user might waste (for example, when diving under water time can be precious, because the amount of time that the diver can stay under water may be limited by the amount of air in the air tanks). The knife 100 or 200 can also cut through webbing if the user replaces the blades occasionally with recommended quality carpet blades or the 440A stainless steel. The blade 160 or 216, for marine grade purposes, is a passivated 440*a* stainless steel blade with a silicone coating. A standard carbon steel blade is recommended for normal non-marine use. The knife 100 or 200 works by either drawing or pulling the knife 100 or 200 against a line or string, making sure the line or string is in the slot of the knife 100 or 200, to produce a cut on the line or string.

In an embodiment, the blade 160 or 216 is a carpet blade that is held in a slot of the knife 100 or 200, used for cutting line, cord or string. The slot 130, 230, and/or 235, which houses the blade 160 or 216, also acts as part of the mechanism that cuts the line or string. The slot 130, 230, and/or 235 has a plastic overhang 180 designed to overhang and cover the blade 160 from both sides, when looked at from an overhead position, by a margin of 3 mm+/−0.3 mm (0.118+/¬0.02 inches) and 3.5+/−0.4 mm (0.138+−0.02 inches), although in other embodiment, the margin could be bigger or smaller. The slot 130, 230, or 235 is designed to expose the blade 160 or 216 from both sides when looked at from an overhead position. In an embodiment, the curve on the directing edge 170, 236 or 244 is convex to the cutting blade and not concave. The directing edge 170, 236, or 244 enhances the cutting action better than a concave directing edge, as it is moving in the same direction as the cutting edge relative to the line. However, in other embodiments other shapes may be used. The blade 160 or 216 can also be a razor blade, with two convex plastic edges 170, 236, or 244, on either side of the cutting edge, overhanging the blade 160 or 216 and compressing the line onto the cutting edge, producing a better, quicker and cleaner cut. The knife 100 or 200 is made of two halves of plastic, sandwiching the blade 160 or 216, respectively.

In an embodiment, the knife 100 or 200 have overall dimensions are (84 mm+/−9 mm)×(36 mm+/−4 mm)×(8 mm+/−1 mm) or (3.3+/−0.33 inches)×(1.417+/−0.15 inches)×(0.32+/−0.03 inches) inches. In general, any dimension specified in this specification may be altered by increasing or decreasing the value of that dimension within a range of at least 10% of the value of the dimension or may be increased in size within a range of 100% of the dimension, although the dimensions of other components may need to be scaled proportionately also. Other sizes and dimension may be used instead of those mentioned explicitly in the specification. The blade 160 or 216 is replaceable, which in an embodiment may be the only disposable part of the knife 100 or 200. In an embodiment, blade 160 is 57.15 mm+/−6 mm long×18.5 mm+/−2 mm wide×0.38 mm+/−0.04 mm thick (or 2.25+/−0.3 inches long, 0.73+/−0.07 inches wide, 0.015+/−0.002 inches thick). In an embodiment, the blade 160 or 216 sits in the middle of the housing, with a screw 142 or 212 going through the middle of the blade 160 or 216 to add to the security of the blade 160 or 216's position. In an embodiment the thickness or half thickness of the overhang 180, 238, or 246 is 2.5 mm+/−0.3 mm (0.098 inches+/−0.09 inches), as can be seen in FIG. 2F. In an embodiment, the cutting edge 162, 226 or 228 of the blade is 5.5+/−0.6 mm (0.216+/−0.03 inches) away from the slot 130, 230, and/or 235 along its length. In an embodiment, at the furthest point on the arm facing the blade, the distance between the cutting edge 226 or 238 of the blade and the directing edge 236, or 244, which is distance 240 or 248, is 4.575 mm+/−0.4 mm on either side. In another embodiment the protection to the fingers is enhanced by the length of the arm having the directing edge 236 or 244, which may be 5 mm+/−0.5 mm (0.197 inches+/−0.02 inches). This protection is afforded by the length of the directing edge, which is 5 mm+/−0.5 mm.

In another embodiment, referring to the surface of the overhang that faces the viewer in FIG. 1C as the top of the overhang, the distance from the flat face of the blade (not the cutting edge) in a direction perpendicular (which is the direction pointing out of the page in FIG. 1C) from the surface of the flat face of the blade (or perpendicular to the relatively flat face of the entire knife assembly) to the top of the overhang is 2.6 mm, 3 mm, 3-4 mm, or 2.6 to 4 mm (the flat face of the blade is parallel to the plane of the blade). In an embodiment the distance from the apex of groove 135 or the apex of the corresponding groove of knife 200 to the cutting edge of the blade closest to groove 135 (where the distance is measured in a direction perpendicular to the cutting edge in the plane of the blade, which would be in a horizontal direction in FIG. 1C) is 3.5 mm, 5 mm, 3.5 mm to 5 mm, or 3 mm to 6 mm.

In an embodiment, the distance between the cutting edge of the blade and the directing edge of the slot is relatively small on either side. In an embodiment, the two halves are held together by 316ss grade stainless steel screws. In an embodiment, the blade is exposed along ¾ of the blade's length for the purpose of cutting line, but the exposed area may be minimized to protect the user's fingers. In another embodiment, the entire length of the cutting edges is exposed for cutting. In an embodiment, the opening to the 216 is about 17 mm+/−2 mm (or 0.47+/−0.05 inches). Since the blade 160 or 216 is a partially covered blade, it minimizes the danger of having an open sided blade being mishandled. The knife 100 or 200 provides a partially sealed blade and it minimizes the danger of having an open sided blade being swung in a dangerous manner or being mishandled.

In an embodiment, knife 100 or 200 is made of two halves of plastic, sandwiching together a blade 160 or 216. In an embodiment, the blade 160 is not placed in the center of the knife, but is located just 2 mm+/−0.2 mm (0.078 inches+/−0.008 inches) off from the edge of the knife 100. In an embodiment, the blade 216 is placed in the center of the knife 200. Having blade 160 or 216 covered by the overhang portion allows the cutting edge 162 of the blade to be further away from the fingers of the user. In an embodiment, the cutting edge may be located 15 mm+/−2 mm (0.59+/−0.06 inches) from the edge of the knife 100 that is furthest from the handle. The sides of the slot 130, 218, or 224 leading to the blade 160 or 216 are relatively short. Even though the knife 100 only has one cutting side, blade 160 has an advantage for technical divers that wear dry suits (not all technical divers wear dry suits, but there is a benefit for those that do) or for anyone else that wears a dry suit (technical diving describe a type of advanced diving which uses sophisticated air management techniques to minimize the possibility of decompression sickness). In an embodiment, blade 160 has just one exposed cutting edge. In an embodiment, the exposed cutting edge is the only cutting edge. In an alternative embodiment, there may be a second cutting edge buried with the casing of knife 100, which is not exposed. When the exposed edge becomes dull, the casing may be opened up, blade 160 may be flipped around, and the casing closed, so that the dull edge is now buried in the case and not exposed while the previously unused edge is not exposed. By pushing the blade 160 further away from the center, allowing just one side for cutting, so that the exposed portion of the blade is further away from the edge of the knife 100 minimizes the risk of accidentally cutting the dry suit (the center refers to the midpoint with respect to the length of knife 100). In contrast, keeping blade 216 centered, keeps each cutting blade further from the edge, the knife 100 minimizes the risk of accidentally cutting the dry suit (the center refers to the midpoint with respect to the width of knife 100).

Blade 160 has an advantage for technical divers that wear use dry suits (as explained above not all technical divers wear wet suits, but there is a benefit for those that do) or anyone else that wears a dry suite. Technical divers also work in zero visibility conditions and a one sided blade minimizes the possibility of accidentally cutting a life saving guide line or the dry suit. Also, in an emergency situation all divers of all grades, stand a much higher chance of dislodging their mask, and there is generally no visibility without the mask. Consequently, all divers, not just technical divers, have a chance of being in zero visibility conditions. In an embodiment, the knife 100 has the possibility of cutting line up to 14 mm thick (0.55+/−0.0060 inches), recognizing the fact that technical divers have a need to cut thick line associated with underwater scooters, kelp, and webbing. Thicker lines may be cut by making the knife larger increasing the size of the opening and the distance of the directing edge to the blade.

The blade 160 or 216 can be a carpet blade (for example) and is replaceable. The blade 160 or 216 is replaceable, and this is the only disposable part of the tool. The carpet blade sits to the side, with a screw going through the tool to add to the security of the blade's position. In an embodiment, the distance of the overhang is 3 mm+/−0.3 mm (0.118+/−0.02 inches). The opening to slot 130, 218 or 224 is 10 mm+/−0.1 mm (0.394+−0.04 inches), away from the cutting edge of the blade. In an embodiment, the distance between the cutting edge 162, 226, or 228 of the blade and the directing edge 170, 236, or 244 is 3.25 mm+/−0.3 mm, respectively.

In an embodiment, in which blade 160 or 216 is replaceable, blade 160 or 216 may be the only disposable part of the knife 100 or 200. In another embodiment other portions of the knife are also replaceable. In an alternative embodiment, blade 160 or 216 is not replaceable, and once blade 160 or 216 wears out, the knife 100 may be disposed of The blade 160 or 216 is situated to the side of the knife 100. A screw 142 extends through the knife 100 to add to the security of the blade 160 or 216's position. The two halves and blade 160 or 216 are held together by a 316ss grade stainless steel screw 142.

In another embodiment, a handle slot 120 or 204 is provided and has a 5 mm+/−0.5 mm (0.197+/0.02 inches) wide opening 120 or 204 at the bottom that is about 26 mm long. In another embodiment the opening is about 26 mm×17 mm. The handle slot 120 is designed to have a piece of 25.4 mm+/−2.3 (1 inch+/−0.1)×177.8 mm+/−18 mm (7 inch+/−0.7 inches) polypropylene webbing, folded around the handle slot 120 or 204 and sewn together, with a two inch piece of Velcro. The knife 100 or 200 is designed to fit into a folded and sewn piece of 2 inch wide Nylon, polypropylene, polyester webbing or other such materials (e.g., leather, canvas, etc.) of lengths 190+/−19 mm (7.48+/−0.8 inches), 210 mm+/−21 mm8.27+/−0.9 inches), and 225 mm+/−23 mm (8.858+/−0.9 inches), depending on which size of pouch may be used. The pouch for the diver's knife is one piece of webbing, and is placed on the wrist around the user's wrist. It can also fit around any diving harness, or professional harness made of 2 inch thick webbing. The pouch is pushed into the arm, and not away from the arm, reducing the amount of danger from entanglement. Also, the webbing folds around the computer watch strap with ease, but leaves the integrity of the pouch in place. In an embodiment slot 120 or 204 is shaped so that it can act as a bottle opener.

Method of Use

Figure 3:
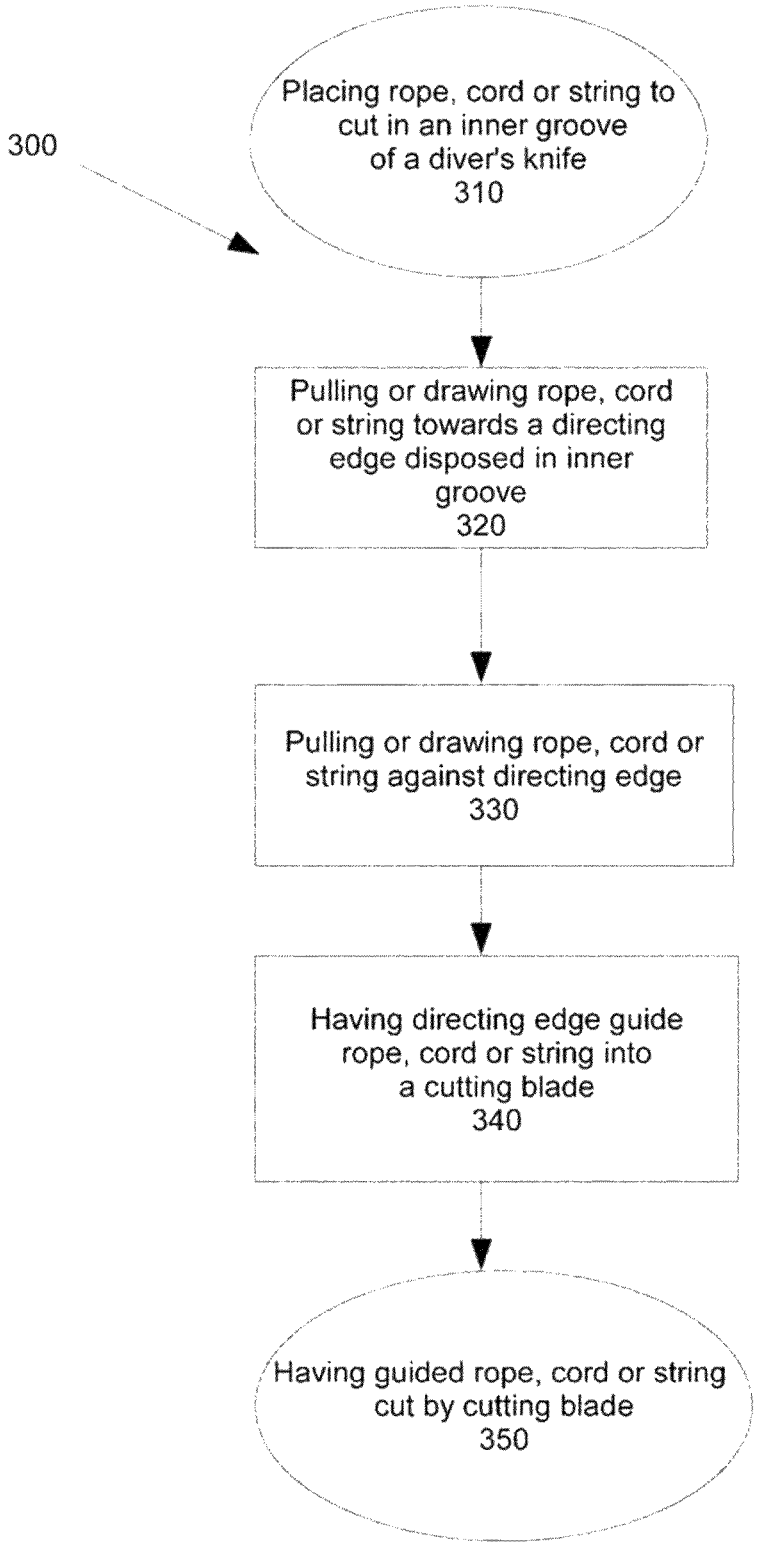
FIG. 3 shows a flowchart of an embodiment of a method for using a diver's knife to cut a line.

FIG. 3 shows a flowchart of an embodiment of a method 300 for using a diver's knife to cut a rope, cord or string. In step 310, a user places the line in the opening of the knife in slot 130 (formed by the arm and the body of the knife). The method 300 utilizes a knife having an arm with a directing edge with a directing edge, which may have a convex shape. In one embodiment, cutting blade is single-sided with one arm and a directing edge on one side. In another embodiment, the cutting blade is double-sided with two arms having directing edges for each blade. In step 320, the user pulls the knife in a direction such that the cord position changes relative to the knife The movement of the knife causes the cord to slide within the slot in a direction parallel to the blade and in a direction such that the line's position (relative to the knife) becomes closer to the point where the arm meets the body of the knife. In step 330, the directing edge directs the line into the blade of the knife. Optionally, to the extent that the blade does not immediately begin to cut into the line, the line is pinched by the groove in the directing edge. In step 340, as the blade is pushed into the line, the line is severed.

In an embodiment, each of the steps of method 300 is a distinct step. In another embodiment, although depicted as distinct steps in FIG. 3, steps 310-340 may not be distinct steps. In other embodiments, method 300 may not have all of the above steps and/or may have other steps in addition to or instead of those listed above. The steps of method 300 may be performed in another order. Subsets of the steps listed above as part of method 300 may be used to form their own method.

Method of Making

Figure 4:
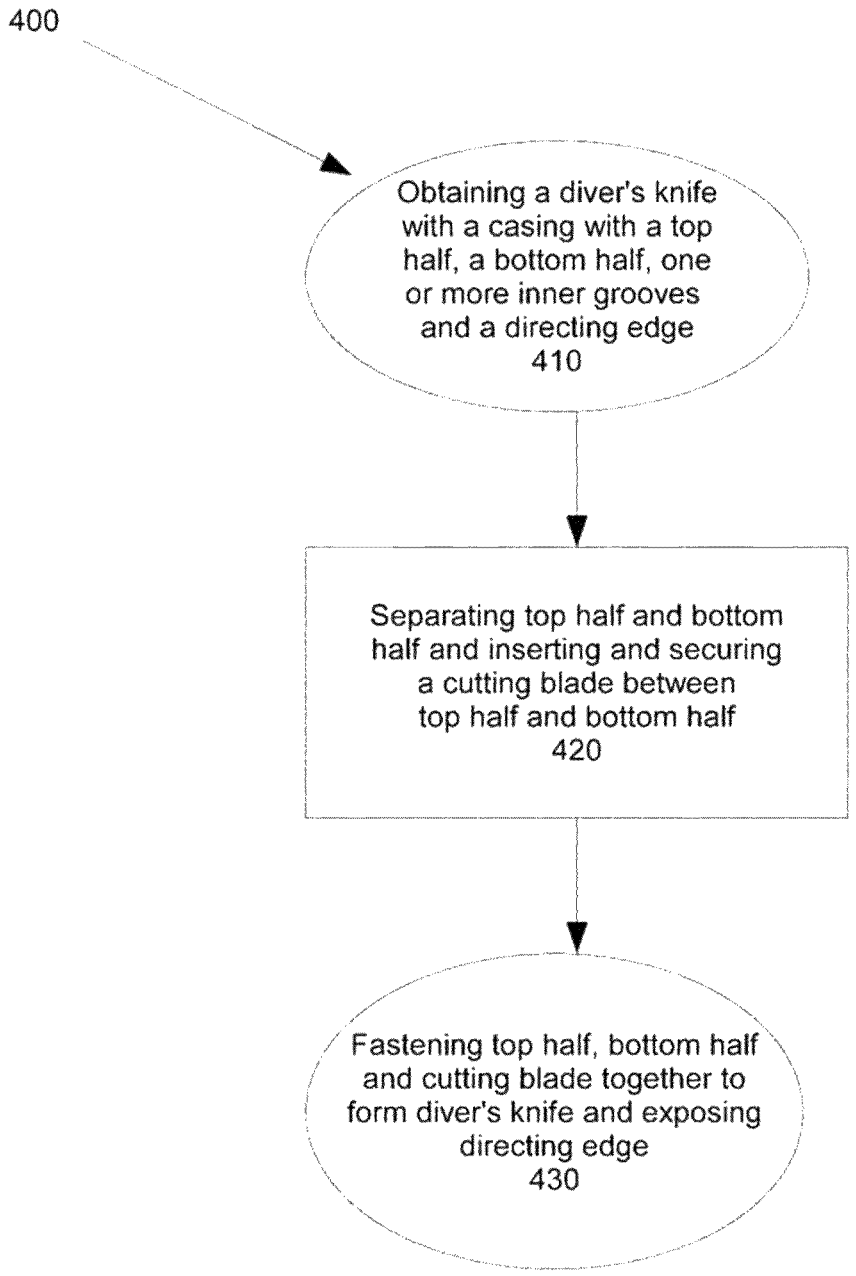
FIG. 4 shows a flowchart of an embodiment of a method for constructing the knife.

FIG. 4 shows a flowchart of an embodiment of a method 400 for constructing a diver's knife. In step 402, the top half of the casing is molded or otherwise formed. In step 404, the bottom half of the cover is molded or otherwise formed. Steps 402 and 404 may include molding the arm having the directing edge, molding a protrusion for holding the blade in one of the top or bottom halves of the casing and a well or another protrusion of the other of the top and bottom halves of the casing that mates with the protrusion on the first of the top and bottom halves of the casing. Steps 402 and 404 may also include forming one or more sockets through fasteners, such as screws or bolts may be placed for fastening the top and bottom halves of the casing together. One or more of the sockets may have a noncircular shape (e.g., hexagonal) for mating with a noncircular shape of a portion of the fastener (e.g., the head of the screw or bolt or with the nut). Steps 402 and 404 may also include forming a well for receiving the blade in one or both of the top and bottom halves of the casing. Steps 402 and 404 may further include forming a handle with a slot for grabbing and/or pulling with a hand. In step 406, the blade is formed by extrusion, casting, or molding and then sharpening one or more of the edges, for example. Forming the blade may include forming one or more apertures within the blade through which the protrusion of the top and/or bottom halves of the casing may protrude. In step 408, the fasteners (e.g., the bolt and nut) are formed by casting or molding, for example. In step 410, the blade is placed onto one of the top half and bottom half of the casing, which may include placing the blade on one or more protrusions and/or in a well to hold the blade from moving sideways. In step 412, the top and bottom halves of the casing are joined together such that the protrusion from one half mates with a well or protrusion on the other half sandwiching the blade between the two halves of the casing in the body of the casing leaving one cutting edge or two cutting edges exposed facing the arm or arms of the casing of the knife. In step 414, the fasteners are placed into sockets in the casing and the top half and bottom half and cutting blade are fastened together to form the knife illustrated in FIGS. 1A, 1B, 1C, 2A, 2B, 2C, 2D, 2E for both the single-sided and double-sided embodiments. Optionally, placing the fasteners into the sockets may cause the fastener to pass through an aperture in the blade.

In an embodiment, each of the steps of method 400 is a distinct step. In another embodiment, although depicted as distinct steps in FIG. 4, steps 402-414 may not be distinct steps. In other embodiments, method 400 may not have all of the above steps and/or may have other steps in addition to or instead of those listed above. The steps of method 400 may be performed in another order. Subsets of the steps listed above as part of method 400 may be used to form their own method.

Figure 5:
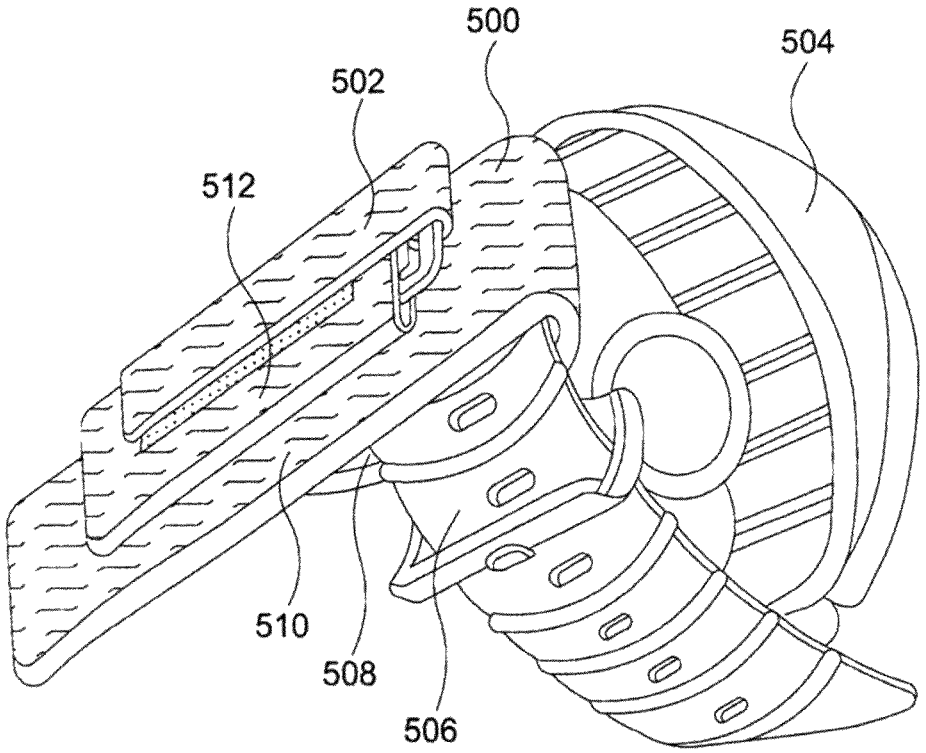
FIG. 5 shows a side view of an embodiment of a sheath for the knife.

FIG. 5 shows a side view of an embodiment of sheath 500. The components of FIG. 5 are, sheath 500, knife strap 502, watch 504, band 506, loop 508, sheath body 510 and sheath enclosure 512. The components that make up sheath 500 are, sheath flap 502, loop 508 and sheath body 510. In other embodiments sheath 500 may have other components in addition to or instead of those shown in FIG. 5.

Sheath 500 holds the knife. In an embodiment, sheath 500 is made of a flexible, abrasion resistant material such as nylon. In other embodiments, sheath 500 can be constructed of other materials, such as leather or neoprene.

Knife strap 502 wrap through the slot at the end of the knife and attaches to the pocket. Watch 504 is a diver's watch, but any band or belt or device including a band or belt may be substituted for watch 504. In an embodiment, sheath 500 is affixed to watch 504 by passing band 506 through loop 508. Band 506 can be any band for a wrist, arm, leg or foot, a diver's watch for example. Loop 508 is created by sheath body 510 being folded back and attached to itself.

In an embodiment, sheath enclosure 512 serves as a place to store either knife 100. Sheath enclosure 512 is affixed to sheath body 510 so that sheath enclosure 512's opening is oriented in the direction of loop 508. In other embodiments, sheath enclosure 512 can have various orientations. Knife 100 is secured within sheath enclosure 512 by knife strap 502, which is attached to the handle of knife 100 and secured to sheath enclosure 512 by a hook and loop material, such as Velcro® or another hook and loop material. When attached to enclosure 512, via the hook and loop material, knife strap 502 prevents the knife from slipping out of enclosure 512. In an embodiment, sheath 500 can be used to store knife 100 or 200 or any type of diving knife.

Figure 6:
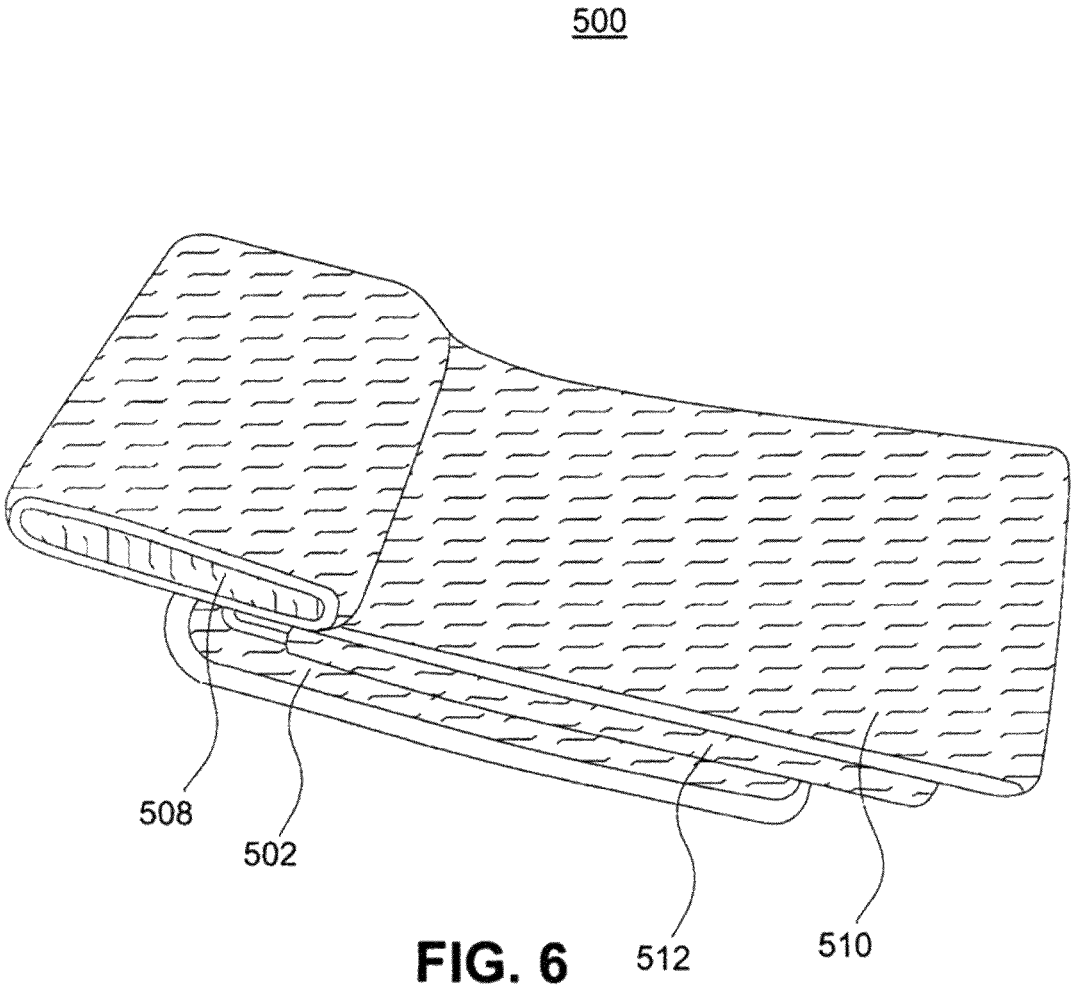
FIG. 6 shows a back view of an embodiment of a sheath for the knife.

FIG. 6 shows a back view of an embodiment of a sheath. The components of FIG. 6 are sheath 500, knife strap 502, loop 508, sheath body 510, and sheath enclosure 512, which were discussed above in conjunction with FIG. 5. In other embodiments, sheath 500 may have other components in addition to or instead of those shown in FIGS. 5 and 6. Loop 508 may be formed by folding back the piece of material that makes up the back portion of sheath enclosure 512.

Figure 7:
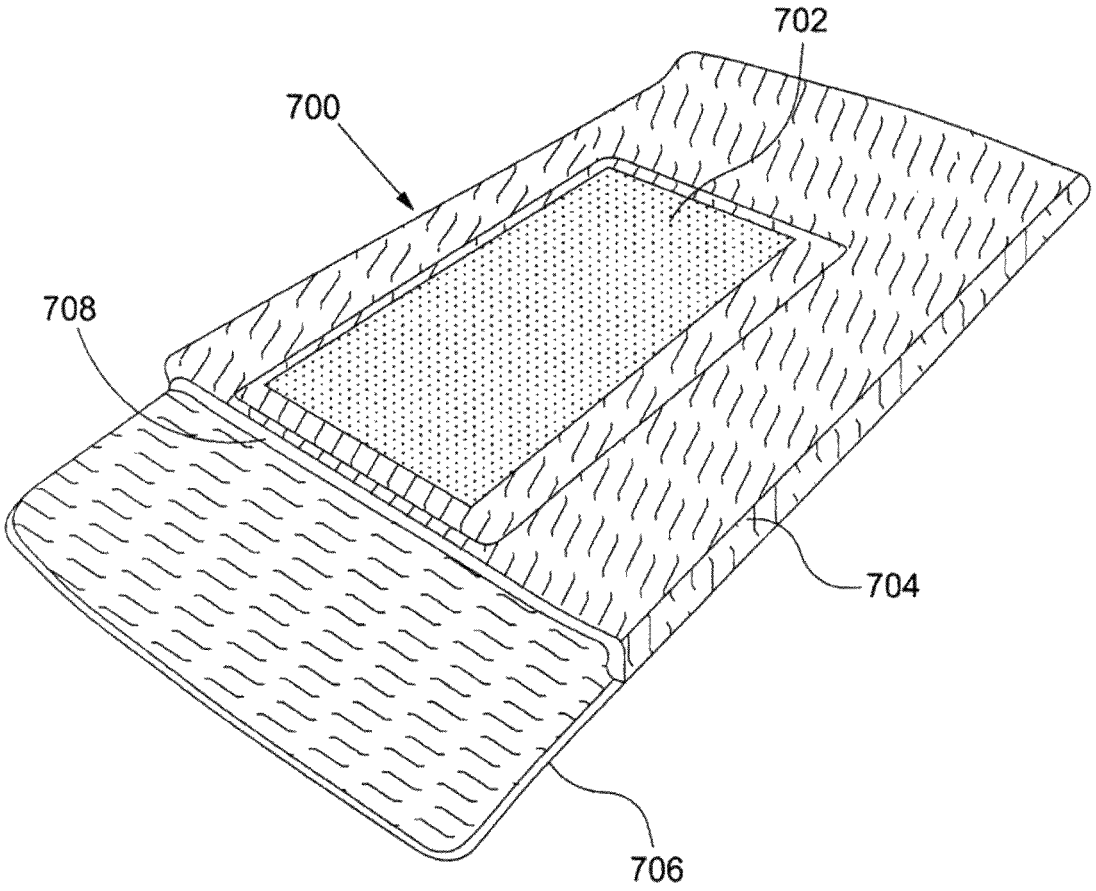
FIG. 7 shows a front view of an embodiment of sheath for the knife.

FIG. 7 shows a front view of a representation of an embodiment of sheath 700, which includes fastener 702, front piece of material 704, back piece of material 706, and pocket 708. In other embodiments, sheath 700 may have other components in addition to or instead of those shown in FIG. 7.

Sheath 700 is another embodiment of sheath that may be used with knife 100 or 200. Fastener 702 may be a hook and loop material, such as Velcro®, or another type of fastener. For example, fastener 702 may be a button or snap. Fastener 702 is attached to the front of pocket 700. For example, fastener 702 may be adhered, glued, heat bonded, or sewn to the front of pocket 700. In this specification whenever two pieces of material are attached, those piece of material may be adhered, glued, heat bonded, or sewn to one another. Front piece of material 704 from the front of pocket 700. Front piece of material 704 has fastener 702 adhered to an outer surface of front piece of material 704. Back piece of material 706 forms the back of the sheath 700. In an embodiment, front piece of material 704 and back piece of material 706 have the same width, but back piece of material 706 is longer than front piece of material 704. Front piece of material 704 and back piece of material 706 are adhered together along the two of the longer edges and one of the shorter edges of front piece of material 704 and back piece of material 706 to form a pocket. Pocket 708 is formed by joining front piece of material 704 and back piece of material 706 along the two of the longer edges and one of the shorter edges.

Figure 8:
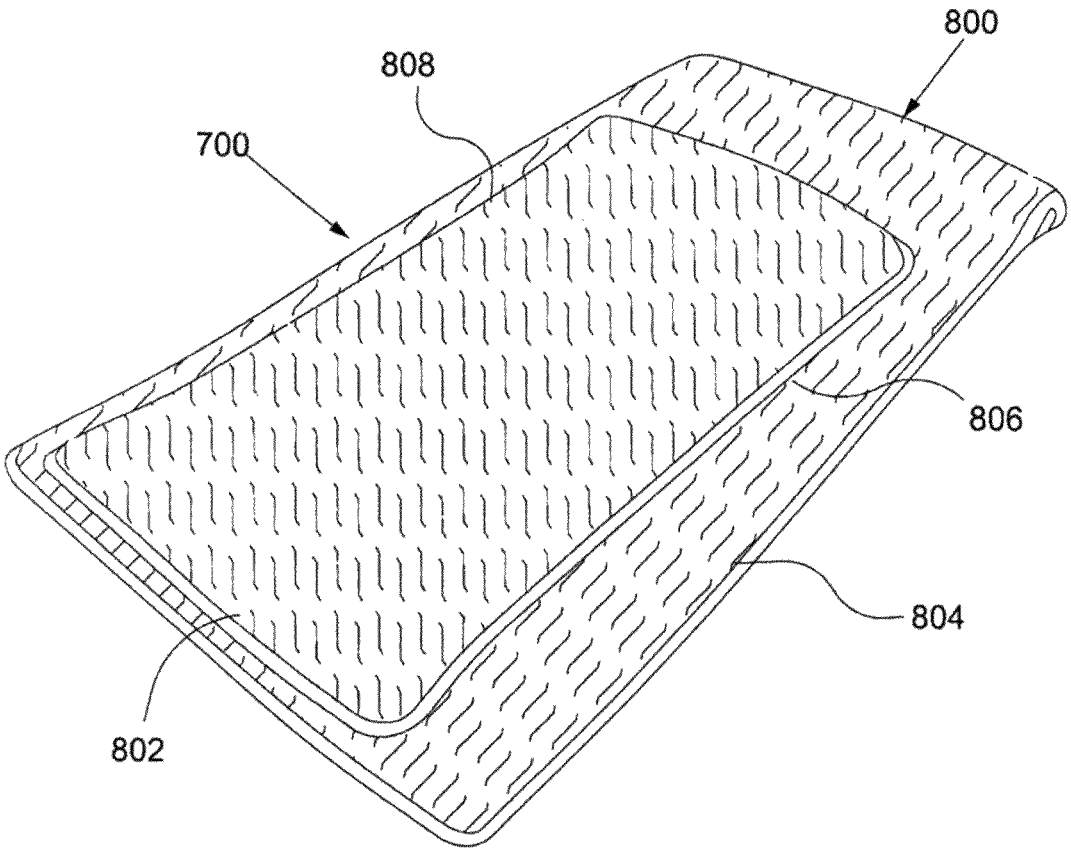
FIG. 8 shows a back view of an embodiment of a sheath for the knife.

FIG. 8 shows the back side 800 of a representation of an embodiment of sheath 700, which includes loop material 802, back 804, first loop opening 806, and second loop opening 808. In other embodiments, back side 800 may have other components in addition to or instead of those shown in FIG. 7.

Back side 800 of is an embodiment of the back side sheath 700. Loop material 802 is attached to the backside of sheath 700 to form a loop. In contrast, loop of sheath 500 is formed by folding the back a piece of material of sheath 500. Back 804 may be the rear side of back piece of material 706. First loop opening 806 and second loop opening 808 are the openings of the loop formed by attaching loop material 802 to back 804.

Figure 9:
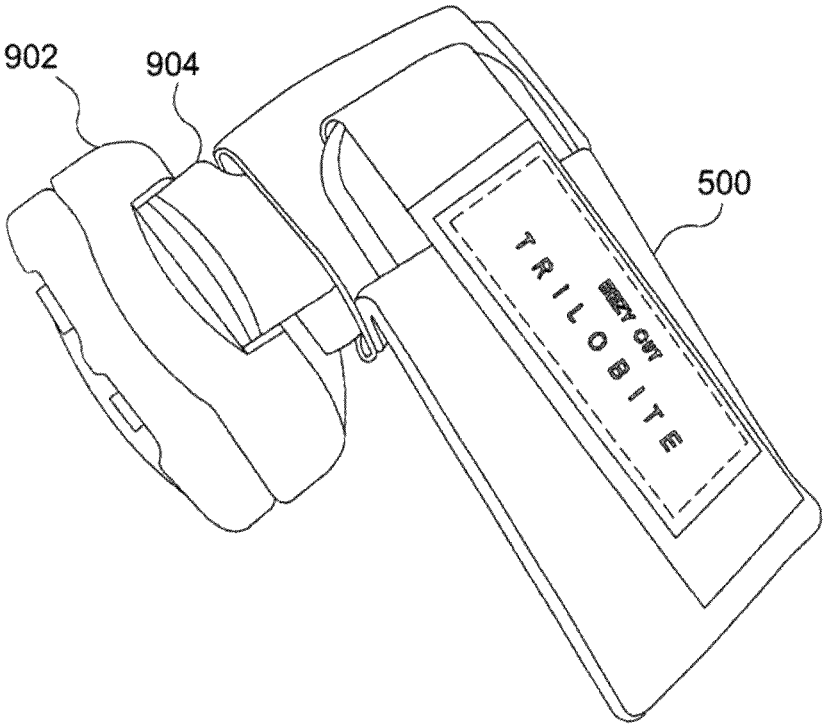
FIG. 9 shows an embodiment of a sheath for the knife on a watch having a band.

FIG. 9 shows sheath 500, on a diver's watch 902, having band 904. Band 904 is placed through loop 508. In other embodiments, the equivalent view to that shown in FIG. 9 may have other features in addition to or instead of those shown in FIG. 9.

Figure 10:
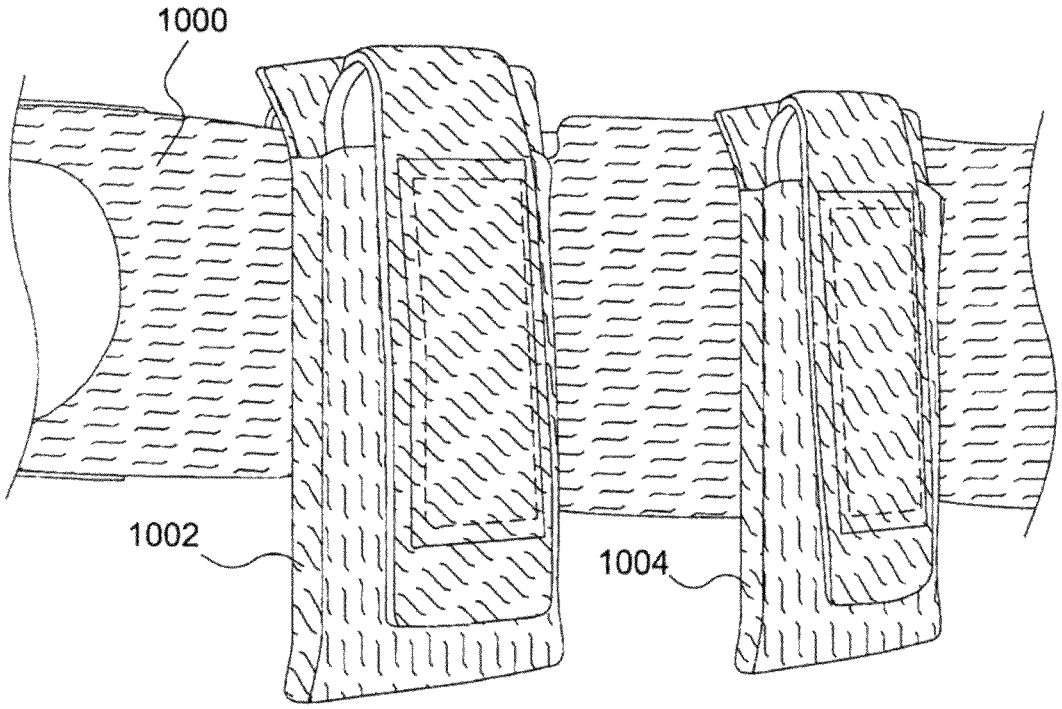
FIG. 10 shows an embodiment of a utility belt for holding sheaths for the knife.

FIG. 10 shows a utility belt holding sheaths for knife 100 or 200, having utility belt 1002, sheath 1004, and sheath 1006. In other embodiments, the equivalent view to that shown in FIG. 10 may have other features in addition to or instead of those shown in FIG. 10.

Sheaths 1004 and 1006 may be embodiment of sheath 700. Utility belt 1002 slides through the loops that correspond to loop of sheath 700.

Figure 11:
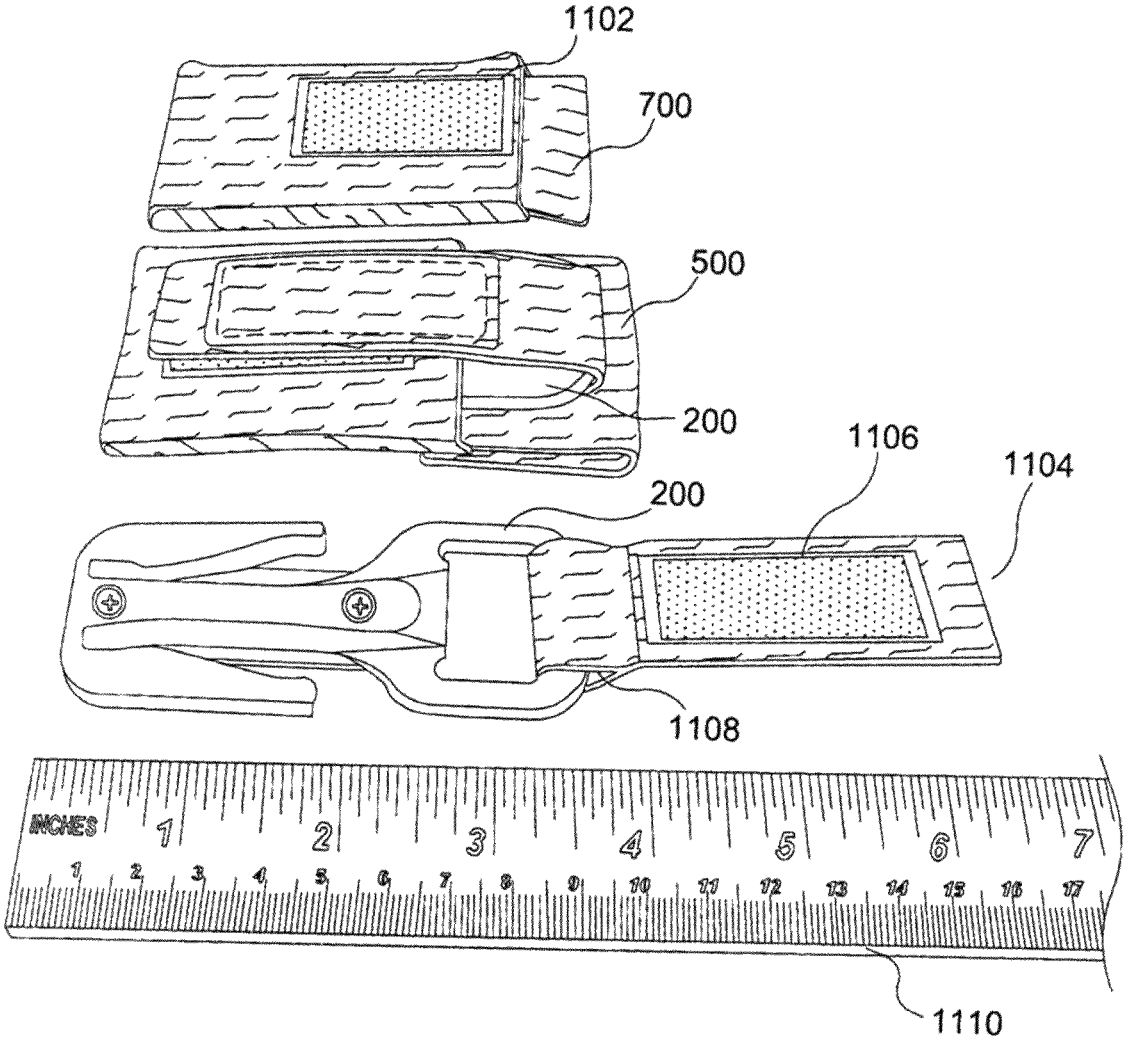
FIG. 11 shows the relative sizes of embodiments of sheaths for the knife.

FIG. 11 shows the relative sizes of sheaths 500 and 700. FIG. 11 includes knives 200, sheath 500, sheath 700, fastener 1102, strap 1104, fastener 1106, loop 1108, and ruler 1110. In other embodiments, the equivalent view to that shown in FIG. 11 may have other features in addition to or instead of those shown in FIG. 11.

Knives 200, sheath 500, sheath 700 were discussed in conjunction with FIGS. 2, 5, and 7, respectively, for example. Fastener 1102 may be an embodiment of fastener

702, which was discussed in conjunction with FIG. 7. Strap 1104 may be an embodiment of strap 502, which was discussed in conjunction with FIG. 5, for example. Fastener 1106 complements fastener 1102, such one engages the other to fasten. For example, one of fastener 1102 and 1106 may have the hooks and the other may have loops, of the hook and loop material. As some other examples, one of fastener 1102 and 1106 may be button and the other the button hole, or one of fastener 1102 and 1106 may be male snap and the other the female snap. Loop 1108 holds strap 1104 to knife 200 (or knife 100). Loop 1108 may be formed by folding over one edge of strap 1104 and attaching that edge to a lower portion of strap 1104. Ruler 1110 is provided to show the size of the embodiment of knives 200, sheaths 500 and 700, and strap 1104 of FIG. 11. The image is foreshortened, which must be taken into account when using ruler 1110 to measure other items in FIG. 11.

Other Embodiments of Single Head Knife

In an embodiment, aperture 166 or 230 is ovular in shape formed by two semicircular endings connected by straight edges. In other embodiment, aperture 166 or 230 has other shapes and the post or posts that hold aperture 166 or 230 in place may have complementary shapes or other shapes that hold aperture 166 or 230 in place. In another embodiment, aperture 166 or 230 is replaced with two or more smaller apertures, through which two or more posts may protrude holding blade 160 or 216 in a fixed position.

Blade 160 or 216 may be replaced with any blade and cover 150 may be replaced with another cover that holds the blade in place and includes an overhang with an edge that pushes the line or rope in the cutting edge. For example, an enclosure may be made for encasing an ordinary knife inside a structure that only allows a portion of the cutting edge (one or both sides) of the blade to be exposed and opposite the exposed portion of blade there may be an overhang with a convex edge for pushing the rope or line into the blade. The exposed portion of the blade may be straight. Screws 142 or 212 and hex nuts 144 or 214 may be replaced, or augmented, with other fasteners, such as rivets, snaps, clasps, buckles, nails, and/or an adhesive. For example, rather than screws 142 or 144 screwing into a bolt, screws 142 or 144 may screw into a socket in casing 110 or 202. Instead of casing 110 or 210 having two halves that are fastened together, casing 110 or 202 may have more components and/or may be divided into different components. For example, Casing 110 or 202 may be one integral piece of material, or may have two portions on both sides of blade 160 or 216 instead of on the top and bottom of blade 160 or 216.

Double Headed Knife

Figure 12:
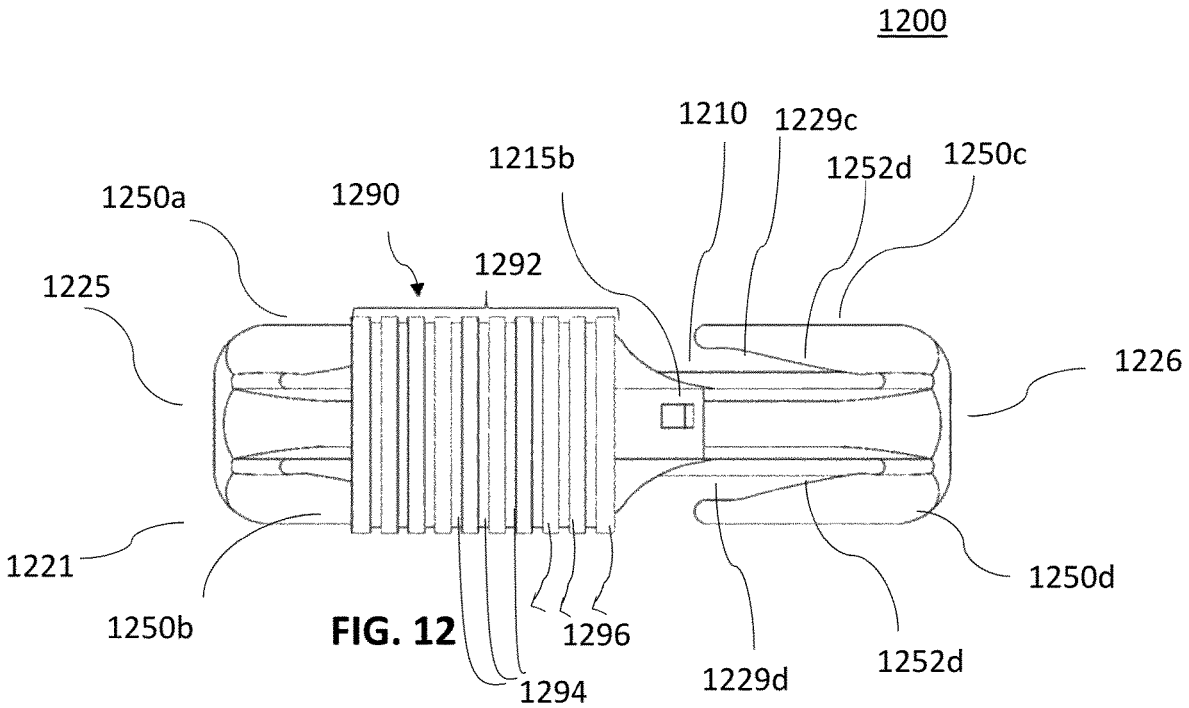
FIG. 12 shows a photo of an embodiment of a knife having a sliding sleeve in the left position.

FIG. 12 shows a diagram representing an embodiment of a double headed knife 1200. The double headed knife 1200 may include blade(s) 1210, right outer protrusion 1215*b*, top half of the casing 1221, head(s) 1225 and 1226, slot 1229*c* and *d*, arms 1250*a-d*, and sliding sleeve 1290 having grip 1292, channels 1294 and bands 1296. In other embodiments 1200 may not have all of the elements or features listed and/or may have other elements or features instead of or in addition to those listed.

FIG. 12 shows a diagram representing an embodiment of a double headed knife having two heads and a sliding sleeve that allows for covering one or more blades. The knife of FIG. 12 is similar to the knife of FIGS. 1-11 except that the handle has been replaced by a second head facing the opposite direction as the first head, and a sliding sleeve that has three positions in which the sliding sleeve does not slide smoothly. The term sliding sleeve and sliding cover may be used interchangeably throughout this specification. Either term may be substituted for the other to obtain different embodiments. In FIG. 12 the sliding sleeve of the double headed knife is in the left most position, and is poised so that either of the two blades on the head at the right end of the knife may be used.

In an embodiment, the dimensions of either of the heads of the knife of FIG. 12 are the same as the head of the knife of FIGS. 2E and 2F (except that the knife in FIGS. 2E and 2F has a handle instead of a second head). The double headed knife has a second head having the same dimensions as the first head. Having two heads of the same dimensions allows the user not to have to worry about which direction the knife is oriented when reaching for the knife to use the knife in emergency situations or in situations with low visibility. Also, for those that do not need to keep all four cutting edges sharp for safety reasons, having two heads, provides four useable cutting edges, allowing the user to delay longer before needing to discard the knife or change the blades.

The sliding sleeve may slide to one position in which the sliding sleeve covers the two cutting edges of the first head (so that either cutting edge of the second head may be used), a second position in which the sliding sleeve covers all four cutting edges (to protect the one carrying the knife from being cut by any of the blades when the knife is not in use), and a third position in which the sliding sleeve covers the two cutting edges of the second head (so that either cutting edge of the first head may be used.

Double headed knife 1200 has two identical heads—one at each end of the knife. Each head has two cutting edges. The two cutting edges of each head may be opposite edges of the same blade or may be the cutting edges of two separate blades. The casing is formed such that it has a center and two heads all having approximately the same width. The blades are situated in an opening of the casing that is formed by an arm and a thinning of the casing, forming an opening with a groove at the bottom of the arm. Each head of the double headed knife 1200 includes an overhang (arm) and a directing edge that is located on the overhang (e.g., on the arm) opposite the blade and may have a convex shape that bulges inwards towards the knife blade (and/or towards the cutting blade) directing the line towards the blade as the knife is pulled in a direction parallel to the edge of the blade. In an embodiment, the overhang includes a groove that is opposite the blade, which will tend to pinch, fold, or press the line as the knife is pulled in a direction parallel to the edge of the blade. This form allows for sliding a line into the groove where the line encounters the blade and is cut.

Blade 1210 is held between top casing and bottom casing. Blade 1210 may be secured in place by a fastener. In this specification, in describing the double headed knives, the term "blade" is used to refer to the entire piece of metal, the term "cutting edge" is used just to refer to the edge of the piece of metal that is supposed to be sharp, so as to cut (although the cutting edge is supposed to be sharp, the cutting edge may dull after many uses). In FIG. 12, blade 1210 is exposed so that blade 1210 can cut a line. The blade 1210 may include any type of cutting edge(s). In an embodiment, blade 1210 is replaceable. In an embodiment, blade 1210 is made of passivated 440*a* stainless steel with a silicone coating for marine use and ordinary carbon steel for non-marine use. In an embodiment, blade 1210 may be a razor blade. Blade 1210 may be a single blade 1210 with two cutting edges and either edge can be used for cutting line.

Right outer protrusion 1215*b* functions to hold the sliding sleeve in a specific fixed position covering the head on the right. The other protrusions on the casing will be discussed in more detail in FIGS. 15A and 15B.

Right outer protrusion 1215*b* is one of four protrusions. Right outer protrusion 1215*b* functions to assist in holding the sliding sleeve in a position at the right end of the double headed knife. The right outer protrusion 1215*b* interacts with a protrusion on the sliding sleeve to hold the sliding sleeve in a fixed position on the right side of the double headed knife. When the sliding sleeve is on the right side of the double headed knife, the opening leading to the cutting edges of blade 1210, which is on the left side of the double headed knife (e.g., the left head), are not covered by the sliding sleeve, and knife 1200 can be used to cut a line with blade 1210.

Top half of the casing 1221 functions as one side of the casing. Top half 1221 and bottom half are sandwiched together and secured in place by a fastener, such as screw, bolt, rivet, clasp or other fastener. Casing may be made of any plastic polymeric material. In alternative embodiments, casing may be made of other materials, such as other plastics, wood, metals, or ceramics. Any place in the specification where plastic is mentioned, Kevlar®, wood, ceramic, or another material may be substituted.

Heads 1225 and 1226 are the left and right head of the double headed knife. Each head has two cutting edges, which may be located on opposite edges of the same blade. There are four overhanging arms, each blocking one of the cutting edges, so as to reduce the likelihood of the user inadvertently cutting the user and inadvertently cutting a line, a wet suit, or other item that the user did not intend to cut. In FIG. 12, the sliding sleeve covers head 1225 allowing head 1226 to be used for cutting.

Each of slots 1129*c* and 1229*d* is an area bounded by one of the arms of head 1226 and one of the cutting edges of the blade 1210. Slot 1220*c* is bounded by the arm of head 1226 in the upper portion of FIG. 12 and the cutting edge of blade 1210 of the upper portion of FIG. 1210, whereas slot 1229*d* is bounded by the cutting edge of blade 1210 in the lower portion of FIG. 12 and the arm of head 122 in the lower portion of head 1226. For a typical double headed knife, there are four slots. Slot 1229*d* is similar to slot 130, which is discussed in FIG. 1B. When cutting line with head 1226, knife 1200 is positioned so that line will enter one of the slots 1229*c* or *d* as knife 1200 is pulled by the user in a direction towards head 1225 (the head that is covered by the sliding sleeve), while holding head 1225.

Arms 1250*a-d* overhang the blades, direct the line into the blades, and help protect users from inadvertently cutting themselves or the wrong line with the blade. Arms 1250*a-d* shield the cutting blade from accidently coming in contact with, and cutting, objects and part of the body, such as the line on a parachute, and part of a wet suit, for example.

Directing edges 1252*c* and 1252*d* are edges of arms 1250*c* and 1250*d*, respectively which direct the line into blade 1210 as the knife travels with respect to the line, so that the line moves with respect to the knife 1200 towards the closed end of slot 1229*c* and 1229*d*, respectively. Each arm has a directing edge that is located on the arm opposite a cutting edge of a blade. Each of directing edges 1252*c* and 1252*d* may have a convex shape that bulges inwards towards a cutting edge of blade 1210, of knife blade (directing the line towards the blade as the knife is pulled in a direction parallel to the edge of the blade). The directing edges of arms 1250*a* and 1250*b* are similar to directing edges 1252*c* and 1252*d*, having the same shape and purpose. The tail of the arm is the part at the opening and the head of the arm is the part of the arm having the groove (see FIG. 14).

Sliding sleeve 1290 (also called "sleeve" or "sliding cover"), is a cover that slides in the center of the knife, between the two heads. The sliding sleeve 1290 has three stable positions in which the sleeve tends not to move. The three positions include a right position, center position, and left position. When the sliding sleeve is in the right position either of the two blades on the left side of the knife can be used. More accurately, when the sliding sleeve is in the right position two openings on the left side of the knife are exposed that allow the user to insert a line between one of the arms and one of the cutting edges of one of the blades—each opening allows the line to be inserted between a different combination of an arm and a cutting edge of the knife. Similarly, when the sliding sleeve is in the left position, two openings on the right side of the knife are exposed that allow the user to insert a line between one of the arms and one of the cutting edges of another blade. When the sliding sleeve is in the center position all four openings are covered, hindering usage of all four of the blades, decreasing the likelihood of the user inadvertently cutting something.

Grip 1292 helps the user firmly grip the sliding sleeve 1290 in order to slide the sliding sleeve 1290 to different positions on the double headed knife. The grip 1292 also helps the user to manipulate the knife to cut line. Channels 1294 are channels in the sliding sleeve grip 1292 that run perpendicular to the cutting edges and parallel to the openings of the sliding sleeve 1290. Bands 1296 are parallel to the channels 1294. Channels 1294 are the channels between bands 1296. The combination of the channels 1294 and bands 1296 form grip 1292. In other embodiments, grip 1292 may have a different shape without channels 1294 and/or bands 1296.

Figure 13:
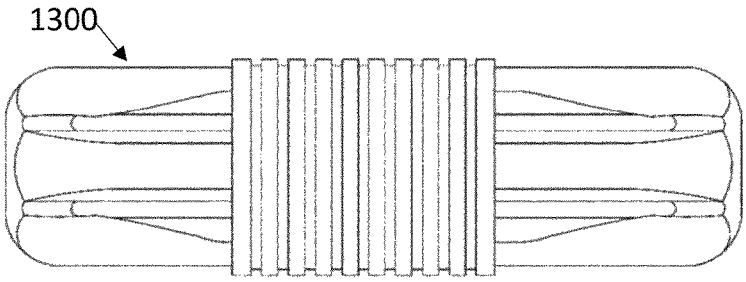
FIG. 13 shows a photo of an embodiment of a knife having a sliding sleeve in the center position.

FIG. 13 shows a representation of a knife 1300. Knife 1300 is an embodiment of, or may be, knife 1200. However, the sliding sleeve knife 1300 is in the center position in which all four openings to all four slots are covered.

Figure 14:
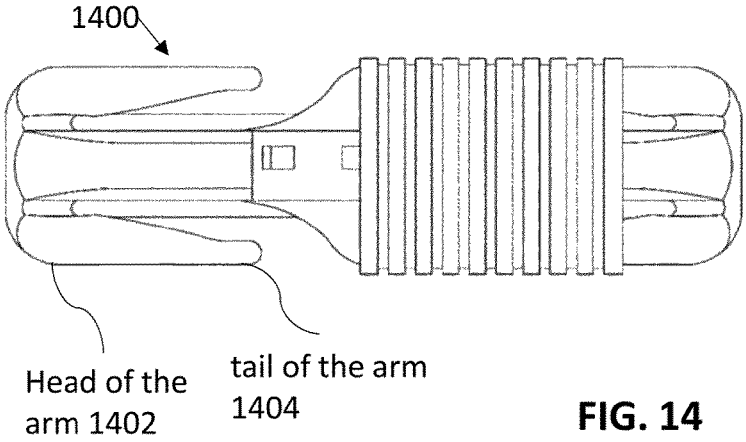
FIG. 14 shows a photo of an embodiment of a knife having a sliding sleeve in the right position.

FIG. 14 shows a representation of a knife 1400 having head of arm 1402 and tail of arm 1404. Knife 1400 is an embodiment of, or may be, knife 1200. The sliding sleeve of knife 1400 is in the right position with the two openings on the left side of the knife (and head 1225) exposed. In the position of FIG. 14, the user can use the left side and/or left head (head 1225) to cut a line. The head of arm 1402 is the portion of the arm that is closest to the closest end of the knife, and the tail of arm 1404 is the portion of the arm that is furthest from the closest end of the knife.

Figure 15A:
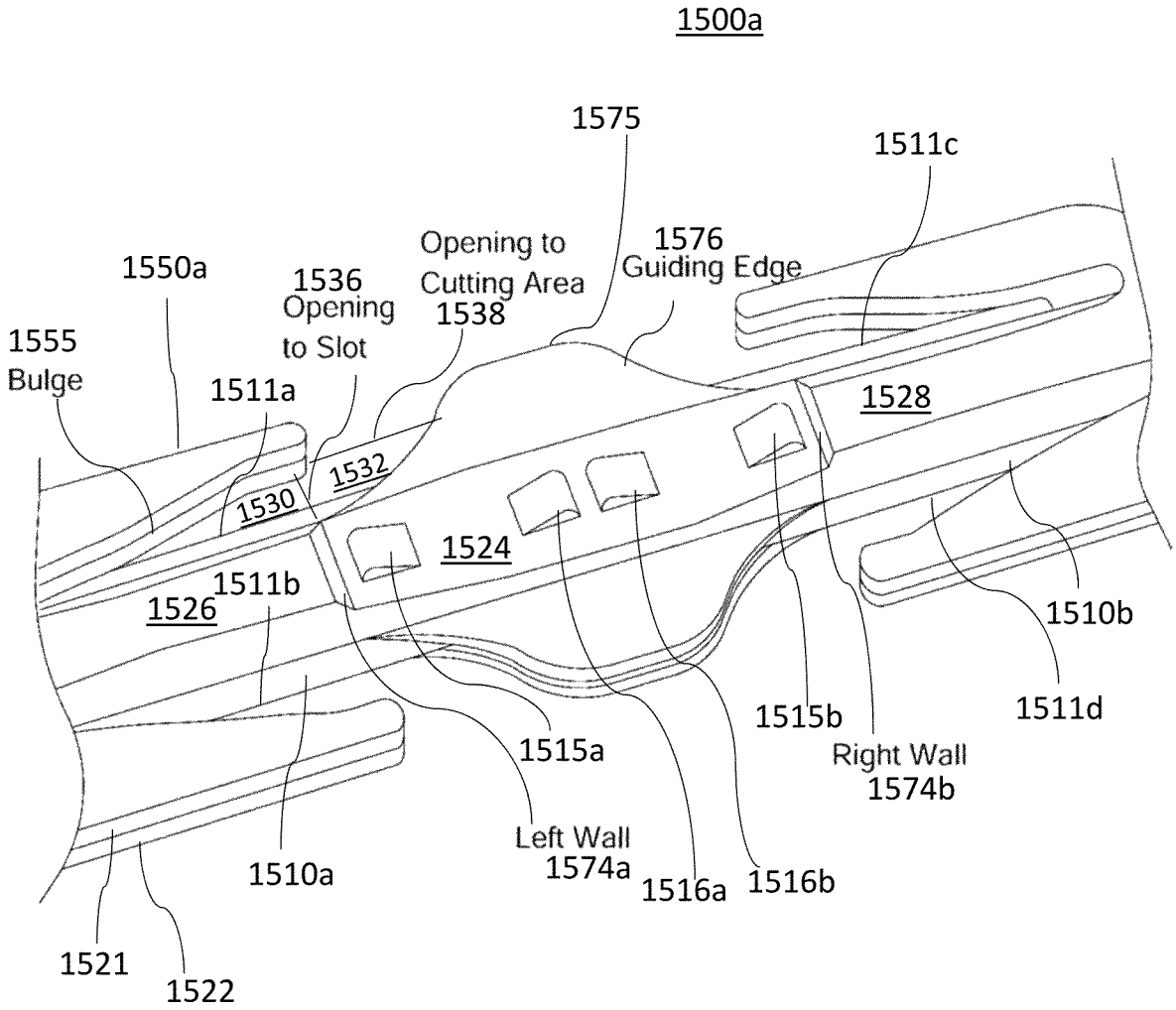
FIG. 15A shows a close up of the center portion of an embodiment of a knife with the sliding sleeve removed.

FIG. 15A shows a diagram of a representation of a close up of the center portion of an embodiment of a double headed knife 1500*a* with the sliding sleeve removed. The center portion of the double headed knife 1500*a* may include blade 1510*a* and 1510*b* (with cutting edges 1511*a-d*), left outer protrusion 1515*a*, right outer protrusion 1515*b*, left center protrusion 1516*a*, right center protrusion 1516*b*, top half of casing 1521, bottom half of casing 1522, surface 1524, surface 1526, surface 1528, slot 1530, entrance area 1532, opening to slot 1534, opening to cutting area 1538, arms 1550*a-d*, bulge 1555, left wall 1574*a*, right wall 1574*b*, center of casing 1575, and guiding edge 1576. In other embodiments 1500*a* may not have all of the elements or features listed and/or may have other elements or features instead of or in addition to those listed.

FIG. 15A shows a close up of the center portion of an embodiment of a knife with the sliding sleeve removed. FIG. 15A provides a more detailed view of the protrusions on the center portion of the top or bottom casing that function to keep the sliding sleeve in a center, right or left position. FIG. 15A also provides a close look at the shape of the center portion of the casing.

Blades 1510*a* and 1510*b* are each embodiments of blade 1210, which was discussed with reference to FIG. 12. The double headed knife 1500*a* may have two blades 1510*a* and 1510*b*, each of which has two cutting edges. When one blade wears out the other may still be used.

Cutting edges 1511*a-d* are the edges of blades 1510*a* and 1510*b* that cut. Cutting edges 1511*a* and 1511*b* are the two sharp edges of blade 1510*a* that perform the cutting, and 1511*c* and 1511*d* are the two sharp edges of blade 1510*a* that perform the cutting. The double headed knife 1200 and 1500*a*, each have four cutting edges, two per blade, so that the user has four blades that may be chosen from based on how worn each blade is.

Left and right outer protrusion(s) 1515*a* and 1515*b* can be any type of protrusion on the top or bottom casing that holds the sliding sleeve in two the side positions. In FIG. 15A, the protrusions (1515*a* and 1515*b*) have a sloping structure. The slope of the outer protrusion (1515*a* and 1515*b*) is at the highest point closest to the head(s). Left and right center protrusion(s) 1516*a* and 1516*b* can be any type of protrusion on the top or bottom casing that holds the sliding sleeve in the center position. Center protrusion(s) 1516*a* and 1516*b* may act to help keep the sliding sleeve in the center of the double headed knife by interacting with a protrusion on the sliding sleeve. In FIG. 15A, the protrusions 1516*a* and 1516*b* have a sloping structure. The slope of the center protrusions (1516*a* and 1516*b*) is at the highest point closest to the center of casing.

The protrusions (1515*a*, 1515*b*, 1516*a*, and 1516*b*) on the casing may be molded or formed at the same time as the casing. The protrusions (1515*a*, 1515*b*, 1516*a*, and 1516*b*) may have any shape, but in at least one embodiment, the protrusions have a triangular shape. The protrusions are not shaped as equilateral triangles and are not symmetrically shaped, but have two faces of unequal lengths, with the highest point of each protrusion closest to one end or the other of the double headed knife as long as, on one side of the protrusion, there is a steep incline that is relatively difficult to slide past and another side with a relatively gradual incline that is relatively easy to slide past. So for each protrusion the sliding sleeve slides past the protrusion with significantly less resistance when sliding past the protrusion in one direction as compared to when sliding past the protrusion in the other direction. Specifically, when sliding past the protrusion in one direction, the sliding sleeve slides over the gradual incline of a first face of the protrusion with no noticeable resistance to the user (the first face of the protrusion faces the oncoming sliding sleeve when the sliding sleeve is on the knife on a first side of the protrusion). Whereas, when sliding past the protrusion in the other direction, the sliding sleeve is stopped by the steep incline of the second face of the protrusion (the second face of the protrusion faces the oncoming sliding sleeve when the sliding sleeve is on the knife on a second side of the protrusion).

In the embodiment shown in FIG. 15A, the protrusions are on the top half of the casing 1521. However, in other embodiments, the protrusions may be on the bottom half of the casing or on both the top and bottom casings. The protrusion will also be discussed further, below, in conjunction with FIG. 15B.

In an embodiment, bottom half of casing 1522 is shaped identically to, or essentially the same as, top half of the casing 1521. However, in an alternative embodiment, only one half of the casing has the protrusions (1515*a*-1516*b*) used to keep the sliding sleeve in a right, center or left position on the double headed knife. In other words, optionally, both the top casing 1521 and the bottom casing 1522 may have the same set of protrusions (any of 1515*a* and *b*, and 1516*a* and *b*) or alternatively only one of the top and bottom casing has the protrusions.

Surface 1524 is the surface that protrusions 1515*a*-1516*b* protrude from. Surface 1524 supports protrusions 1515*a*-1516*b*. Surface 1526 is the portion of the top surface of the top half of the casing that is to the left of surface 1524. Part of the sliding sleeve rides surface 1524 on when the sliding sleeve slides to the left. Surface 1528 is the top surface of the portion of the top half of the casing that is to the right of surface 1524. Part of the sliding sleeve rides on surface 1528 when the sliding sleeve slides to the right. Surface 1524 is lower than surfaces 1526 and 1528.

Slot 1530 is similar to slots 1299*c* and *d*, which were described in FIG. 12. Entrance area 1532 is a region in front of slot 1530. A line that is being cut by cutting edge 1511*a*, first enters entrance area 1532, and then into slot 1530. Entrance area 1532 and slot 1530 together are the cutting area—the area within which the line is cut. Opening to slot 1536 is the opening to slot 1530. Opening to slot 1536 is perpendicular to cutting edge 1511*a*. Line that is being cut passes through opening to slot 1530 when passing from entrance area 1532 to slot 1530. Opening-to-entrance-area 1534 is the opening to entrance area 1532. Line that is being cut first passes through opening-to-entrance-area 1538, then to the rest of the cutting area. Opening-to-entrance-area 1538 is perpendicular to the opening to slot 1536 and parallel to cutting edge 1511*a*.

Opening 1538 is an opening formed by the tail of the arm 1550*a* which is parallel to the blade 1510. Opening 1536 is the imaginary line between the top of the arm and the blade 1510*a*, which is perpendicular to both the tail of the arm 1550*a* and the blade 1510*a* (see FIG. 14 for the placement of the tail of the arm). Thus, for a typical double headed knife, there would be four openings 1536 and 1538. The opening 1536 is formed by an inner side of the arm that faces the blade and a thinning of the casing, where the blade is held and exposed. The opening 1536 is the distance between the side of the arm that faces the blade while also being parallel to the blade and cutting edge of the blade. The opening 1536 in the double headed knife is of a size that is large enough to allow the line or rope to be inserted into the slot with the blade, without being large enough to catch a part of the hand or finger. Opening 1538 corresponds to opening 190 in FIG. 1B and openings 240 and 248 in FIG. 2C. In an embodiment, the opening 1538 is about 17 mm+/−2 mm (or 0.47+/−0.05 inches).

Arm 1550*a* is one of the arms of knife 1500*a*, which is similar to arms 1250*c* and 125*d*. Bulge 1555 is the bulge of arm 1550*a*. In the illustration of the embodiment knife 1500*a*, the bulge is easier to distinguish than in the illustration of the embodiment of FIG. 12. However, each of the arms of the knives of this application may have a bulge that is similar to bulge 1555.

Arm 1550*a* is one of four arms on double headed knife 1500*a*. Arm 1550*a* includes a bulge 1555. Arm 1550*a* is an embodiment of arm 1250*a*, which was discussed with reference to FIG. 12.

Bulge 1555 is the part of the arm that slopes inward toward the blade 1510*b*. Bulge 1555 may function to help guide the line toward the blade 1510*b*.

Left wall 1574*a* and right wall 1574*b* on the center of casing may act to help keep the sliding sleeve from sliding completely off of the casing (and being misplaced or causing injury as a result of all four blade being exposed, making the knife difficult to use without cutting oneself with one of the blades). Left wall 1574*a* and left outer protrusion 1515*a* catch a protrusion from the sliding sleeve to hold the sliding sleeve in the sliding sleeve's left position. Right wall 1574*b* and right outer protrusion 1515*b* catch the protrusion from the sliding sleeve to hold the sliding sleeve in the sliding sleeve's right position.

Center of casing 1575 is shaped in such a way that the center of the casing 1575 can accept the sliding sleeve as a result of surface 1524 being lower than surfaces 1526 and 1528. Center of casing 1575 includes a sloped area (guiding edge) 1576 that helps to produce an opening to the cutting area 1538 between the arms and the blade, and guide the line into the slot 1536 for cutting. The center of the casing 1575 may also include the protrusions (1515*a*-1516*d*), and/or one or more fasteners that keeps the casing and blade immovably together.

Guiding edges 1576*a-d* each guides line that enters the entrance area into the slot that faces the guiding edge. Specifically, guiding edge 1576*a*, while the line is in the entrance area 1532, guides the line to pass into slot 1530. Opening to cutting area 1538 is formed by the arm 1550*a* and the guiding edge 1576*a* and creates an opening for the insertion of a line to be cut. The shape of the arm 1550*a* and guiding edge 1576*a* of the center portion act to guide the line through the opening 1538 into the cutting area (the combination of entrance area 1532 into the slot 1530) and eventually into slot 1530. The same is true for guiding edges 1575*b-d* with respect to the entrance area and the slot nearest each of guiding edges 1575*b-d*.

Figure 15B:
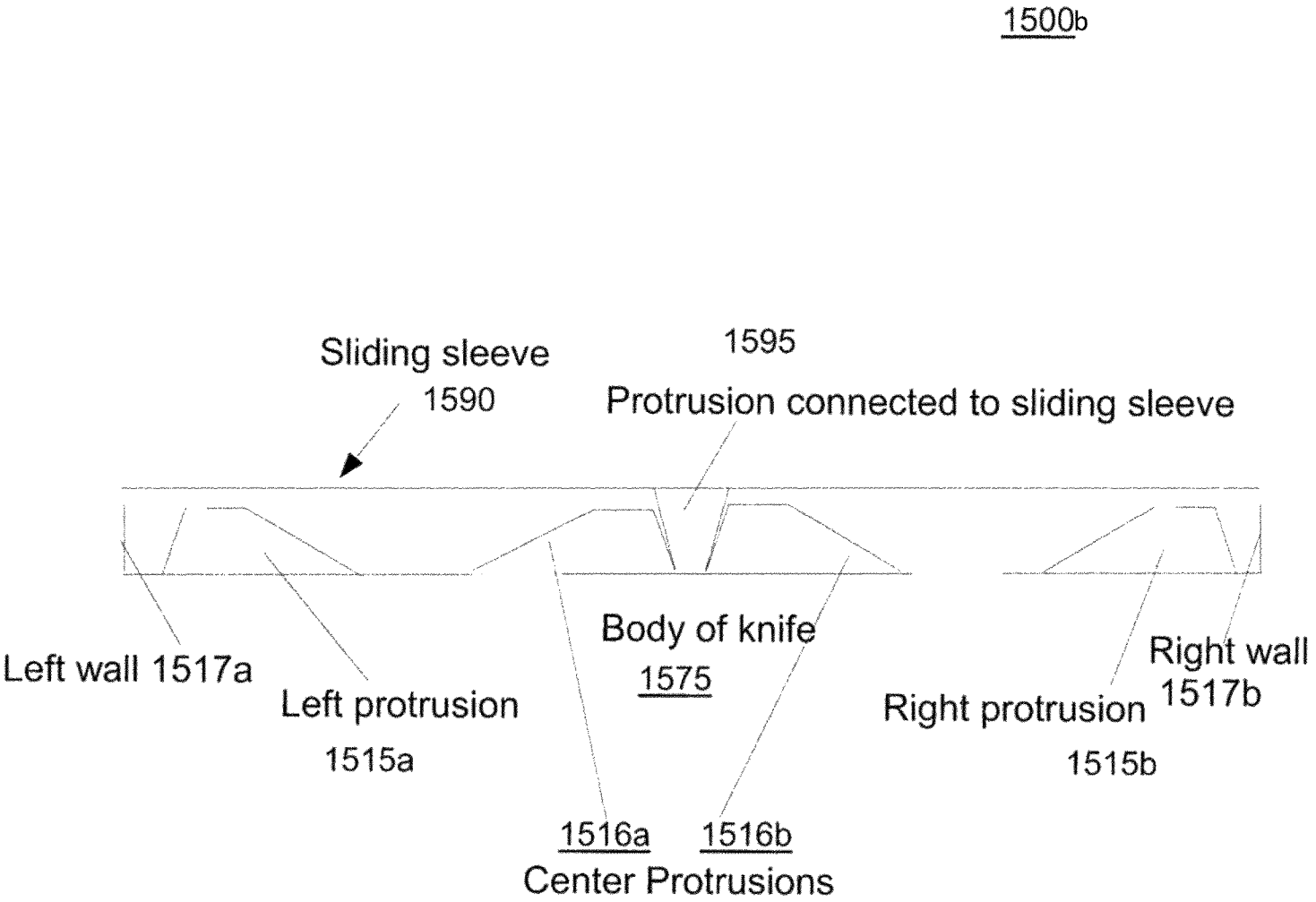
FIG. 15B is a drawing representing an embodiment of a cross-section of the protrusion on the top of the knife and on the inside of the sliding sleeve.

FIG. 15B is a drawing illustrating a side view of an embodiment of the double headed knife surrounded by the sliding sleeve 1500*b*. The double headed knife 1500*b* may include left outer protrusion 1515*a*, right outer protrusion 1515*b*, left center protrusion 1516*a*, right center protrusion 1516*b*, left wall 1517*a*, right wall 1517*b*, body of knife 1575, sliding sleeve 1590, and protrusion 1595 connected to sliding sleeve 1590. In other embodiments 1500*b* may not have all of the elements or features listed and/or may have other elements or features instead of or in addition to those listed.

FIG. 15B is an embodiment of the interaction of the protrusions on the body of the knife and the protrusion on the sliding sleeve when the sliding sleeve is in the center position. The protrusions act to hold the sleeve in one of three positions: in the center covering the blade, or on either end covering one side of the blade.

Left outer protrusion 1515*a* and right outer protrusion 1515*b* have been discussed with reference to FIG. 15A. The left outer protrusion 1515*a* functions to hold the sliding sleeve 1590 in the left position by stopping the protrusion connected to the sliding sleeve (1595) from moving between the left outer protrusion 1515*a* and the left of the center protrusions (1516*a*).

Left and right center protrusions (1516*a* and 1516*b*) were discussed in FIG. 15A. The center protrusions 1516*a* and 1516*b* function to hold the sliding sleeve in the center position. The embodiment shown in FIG. 15B has the sliding sleeve in the center position, because the protrusion connected to the sliding sleeve is being held between the two center-protrusions 1516*a* and 1516*b*.

Body of knife 1575 can be either the top casing or the bottom casing. In other words, the left outer protrusion 1515*a*, the left center protrusions 1516*a*, right center protrusion 1516*b*, and the right outer protrusion 1515*b* can be located on the top casing and/or the bottom casing.

The sliding sleeve 1590 is an embodiment of sliding sleeve 1290, which was discussed with reference to FIG. 12.

The protrusion 1595 is connected to sliding sleeve 1590 can be any shape that can fit between and be held by a protrusion on the casing. In an embodiment, the shape of the protrusion 1595 protruding from the sliding sleeve is complementary to the shape of the region between the two steep faces of the two center protrusions 1516*a* and 1516*b*. The protrusion connected to sliding sleeve 1595 can have a v-shape or rounded semi cylindrical shape, and may be is attached to the inside of the sliding sleeve 1590 (see also FIG. 21). The sides and the ends of the sliding sleeve 1590 are the parts of the sliding sleeve that come in contact with the casing of the double headed knife.

In FIGS. 15A and 15B, there are a set of four asymmetric protrusions (see FIG. 15A, 1515*a* and *b* and 1516*a* and *b*). The left most protrusion 1515*a* holds the sliding sleeve in the left position. The right most protrusion 1515*b* holds the sliding sleeve in the right position. The two center protrusions (1516*a* and *b*) hold the sliding sleeve in the center position. The sliding sleeve has at least one protrusion that protrudes from the inner surface of the sleeve and protrudes towards the knife (see FIG. 21, 2195). The protrusions on the knife (1515*a* and *b* and 1516*a* and *b*) interfere with the movement of the protrusion on the inner surface of the sleeve (thereby interfering with the movement of the sliding sleeve (see FIG. 21, 2195). The sliding sleeve needs to be forced to move in order for the protrusion on the sliding sleeve (see FIG. 21, 2195) to pass over one of the protrusions on the main body of the knife (1515*a* and *b* and 1516*a* and *b*). Each protrusion on the body of the knife (1515*a* and *b* and 1516*a* and *b*) has a steeper slope on one side than the other (and the difference in the slopes is the manner in which the protrusions are asymmetric). As a result of the asymmetry of the protrusions, the sliding sleeve passes past the protrusions (1515*a* and *b* and 1516*a* and *b*) in one direction more easily than the other. The slope on the left outer protrusion 1515*a* is steeper on the left side than on the right side. As a result, the protrusion of the sliding sleeve (see FIG. 21, 2195) passes past the left most protrusion 1515*a* more easily when moving towards the left than when moving towards the right, so that the sliding sleeve slides into the left position more easily than the sliding sleeve slides out of the left position. Similarly, the slope on the right outer protrusion 1515*b* is steeper on the right side than on the left side. As a result, the protrusion of the sliding sleeve passes past the right most protrusion 1515*b* more easily when moving towards the right than when moving towards the left, so that the sliding sleeve slides into the right position more easily than the sliding sleeve slides out of the right position. Likewise, the slope on the two center protrusions 1516*a* and 1516*b* is steeper on the sides between the two center protrusions than on the sides of the two center protrusions that face away from the center. As a result, the protrusion (see FIG. 21, 2195) of the sliding sleeve slides into a position that is between the two center protrusions 1516*a* and 1516*b* more easily than the protrusion on the sleeve (see FIG. 21, 2195) slides out from between the two protrusions 1516*a* and 1516*b* to a position away from being between the two center protrusions 1516*a* and 1516*b*. In other words, the sliding sleeve slides into the center position more easily than the sliding sleeve slides out of the center position, so that the sliding sleeve tends to stay between the two center protrusions 1516*a* and 1516*b* once there. Similarly, the protrusion of the sliding sleeve (see FIG. 21, 2195)

passes past the left most protrusion 1215*a* more easily when moving towards the left than when moving towards the right, so that the sliding sleeve slides into the left position more easily than the sliding sleeve slides out of the left position.

Figure 16A:
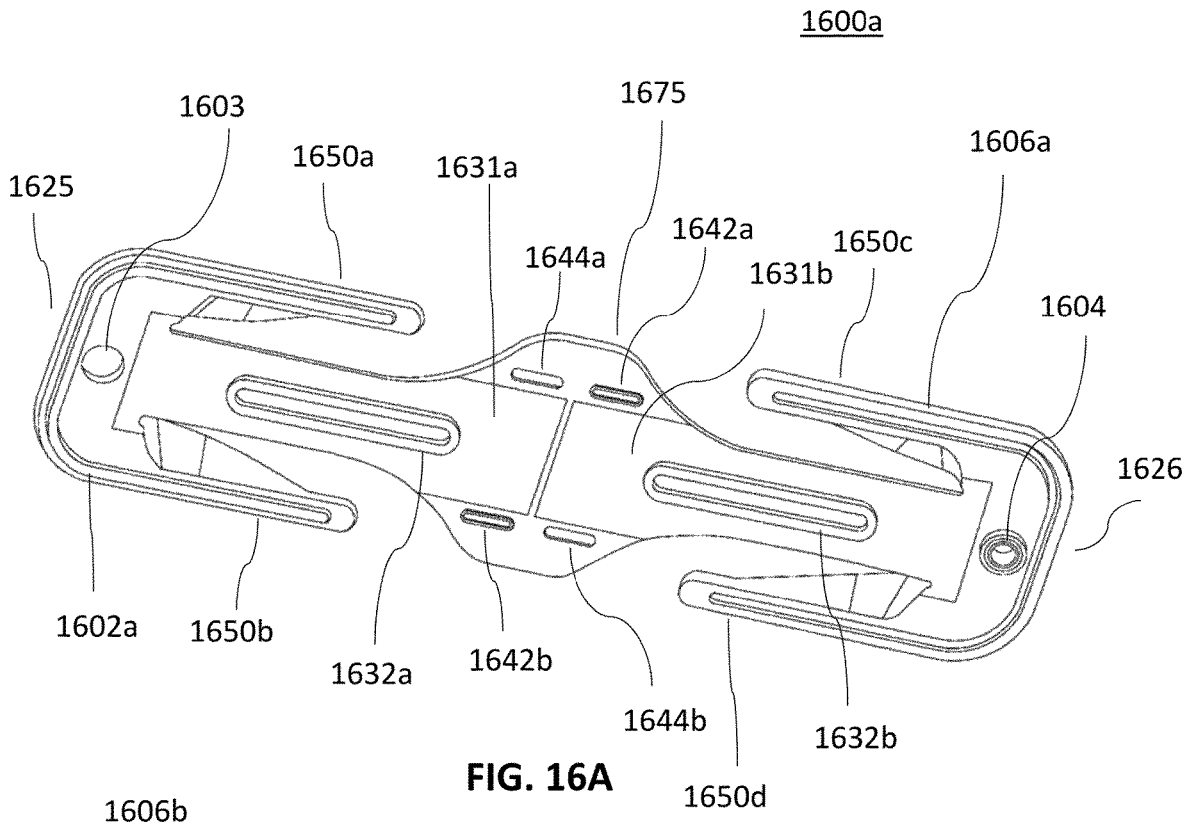
FIGS. 16A and 16B show an illustration of an embodiment of the inner side of the two halves of the knife casing.
Figure 16B:
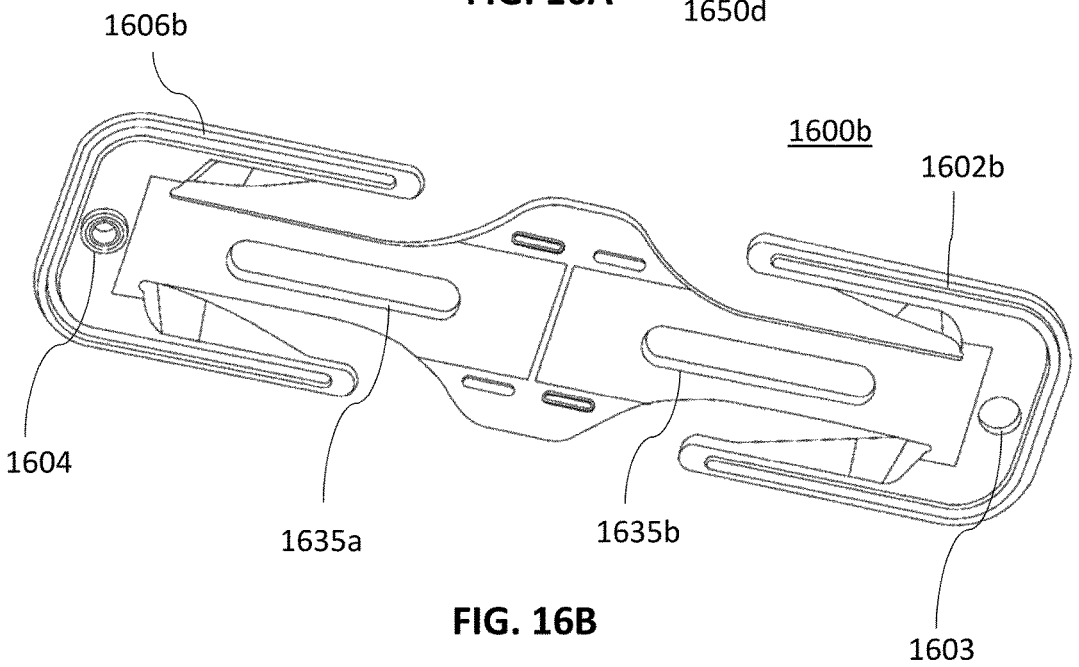

For ease of discussion FIGS. 16A and 16B are discussed together.

FIGS. 16A and 16B show drawings representing the inner side of half of the body of two embodiments of the double headed knife 1600*a* and 1600*b*. The inner side of the top casing 1600*a* of the double headed knife of FIGS. 16A and 16B may include edge raised portion 1602, circular recessed portions 1603*a* and *b*, circular raised portion 1604*a* and *b*, edge recessed portion 1606*a*, top casing 1600*a*, bottom casing 1600*b*, heads 1625 and 1626, wells 1631*a* and 1631*b*, raised blade fittings 1632*a* and 1632*b*, slotted blade recesses 1635*a* and 1635*b*, center recessed portions 1642*a* and *b*, center raised portions 1644*a* and *b*, arms 1650*a-d* and center of casing 1675. In other embodiments 1600*a* may not have all of the elements or features listed and/or may have other elements or features instead of or in addition to those listed.

In this specification the terms recessed portion, recessed fitting, and well may be substituted one for another where ever they appear to obtain different embodiments. In this specification, the terms protrusion, raised fitting, and raised portion may be substituted one for another where ever they appear to obtain different embodiments.

For ease of discussion, one embodiment of the top casing is shown in FIG. 16A and one embodiments of the bottom casing is shown in FIG. 16B. The bottom casing of FIG. 16B is complementary to the top casing of FIG. 16A, in that for every raised portion of FIG. 16B there is a recessed portion in FIG. 16A, and for every recessed portion of FIG. 16B there is a raised portion in FIG. 16A (and the reverse is also true). Each raise portion of top cover of FIG. 16A mates with a recessed portion in the bottom cover of FIG. 16B, and each raise portion of bottom cover of FIG. 16A mates with a recessed portion in the bottom cover of FIG. 16A.

Top casing 1600*a* is the top half of the casing. Bottom casing 1600*b* is the bottom half of the casing. Top casing 1600*a* mates with bottom casing 1600*b* to form the casing of the knife and the hold the blades in the casing.

The inner side of the bottom casing of the double headed knife 1600*b* may include edge raised portion 1602*b*, circular recessed portion 1603, and circular raised portion 1604, edge recessed portion 1606*b* and slotted blade recesses 1635*a* and 1635*b*. In other embodiments 1600*b* may not have all of the elements or features listed and/or may have other elements or features instead of or in addition to those listed.

Edge raised portion 1602*a* is positioned on the edge of the left head 1625 and corresponding arms 1650*a* and *b* of the inside of the casing. Edge raised portion 1602*a* on the top casing (FIG. 16A) engages a corresponding recessed portion 1606*b* on the bottom casing (FIG. 16B).

Circular recessed portion 1603*a* is positioned on the center of the left head of the top casing in FIG. 16A. The circular recessed portion 1603*a* on the top casing FIG. 16A engages a corresponding circular raised portion on the bottom casing FIG. 16B to assist in holding close the casing and to hold the blade in place within the recess for holding the blade.

Circular recessed portion 1603*b* is positioned in the center of the right head of the bottom casing in FIG. 16B. The circular raised portion at the center right on the top casing engages the corresponding circular recessed portion 603*b* on the bottom casing to close the casing and hold the blade in place within the recess for holding the blade (the well).

Circular raised portion 1604*a* is positioned in the center of the right head of the top casing in FIG. 16B. The circular raised portion 1604*a* on the top casing engages a corresponding recessed portion 1603*b* on the bottom casing to close the casing and hold the blade in place within the recess for holding the blade (the well).

Circular raised portion 1604*b* is positioned in the center of the left head of the bottom casing in FIG. 16B. The circular raised portion 1604*b* on the bottom casing engages a corresponding recessed portion 1603*a* on the top casing to close the casing and hold the blade in place within the recess for holding the blade (the well).

In other words, FIGS. 16A and 16B one side of the casing (e.g., 16A) has a circular recessed portion 1603*a* and a circular raised portion 1604*a* on the left edge right edge, respectively, that are configured to mate with the circular raised portion and recessed portion, respectively, (1604*b* and 1603*b*) which are on the other side of the casing (e.g., 16B), opposite circular recessed portion 1603*a* and a circular raised portion 1604*b*. The mating of the circular protrusion with the circular recess acts to attach and align the two sides of the casing together. Other protruding and recessed areas on the inside of the casing can help with the attachment and alignment of the two sides of the casing to each other, including the center raised and recessed portions, the edge raised and recessed portions, and the raised protrusions for the slotted aperture (of the blade) and the slotted blade recesses. In other embodiments, a protrusion can be a recess and vice versa as long as a protrusion is on one side of the casing (e.g., 16A or 16B) and the recess is on the other side of the casing (e.g., 16B or 16A) so the protrusion and recess can mate.

Edge recessed portion 1606*a* is positioned along the edge of the right head 1626 and corresponding arms of the inside of the casing. Edge raised portion 1606*a* on the top casing engages a corresponding recessed portion on the bottom casing 1602*b*.

Right head 1625 is the portion of the top casing 1600*a* that forms the right head and left head 1626 is the portion of the casing 1600*a* that forms the left head of the casing.

The wells 1631*a* and *b* are depressions that function to hold a blade in between the two casings without leaving a gap. The width of wells 1631*a* and *b* is at least as wide as the blade, and the width of wells 1631*a* and *b* is at least as long as the blade, so that the blade rests within wells 1631*a* and *b*. The well 1631 is formed around a raised fitting that is formed to fit the slotted aperture within the blade. Thus, the blade is inserted into a well 1631*a* around a raised blade fitting.

Raised blade fittings 1632*a* and *b* are the raised portions that are oval shaped to allow a razor blade to fit over. The shape of the raised fitting 1632 can be varied depending on the shape of an opening in the desired blade that is used. Raised fitting 1632 mates with the slotted aperture 166 and/or 230 in the blade 160 and/or 216, respectively. Raised blade fittings 1632*a* and *b* (the two center protrusions) on the center part of the casing engage the slots in the center of a typical razor blade and the two center recesses mate with raised blade fittings 1632*a* and *b* the protrusions.

Slotted blade recess 1535*a* and *b* are recess on bottom casing 1600*b* that mate with raised blade fittings 1632*a* and *b*, respectively. Raised blade fittings 1632*a* and *b* are provided to accommodate slotted blade recess (1635*a* and *b* in FIG. 16B) and hold blade in place. Raised blade fitting 1632*a* is a protrusion sitting within a rectangular shaped well 1631. Blade sits in the well 1631*a*, while recess 1635*a* mates with raised fitting 1632*a*.

Center recessed portion 1642*a* and *b* and center raised portion 1644*a* and *b* are small recesses and raised portions, respectively, provided on the inside of the center portion of the casing. Opposite center recessed portions 1642*a* and *b* and center raised portions 1644*a* and *b* are provided on the bottom center of the casing to mate with the raised and recessed portions on the top casing. Center recessed portion 1642*a* and *b* of FIG. 16A, center raised portions 1644*a* and *b* of FIG. 16A, and the corresponding recessed and raised portions of the bottom casing of FIG. 16B can help to attach the top casing to the bottom casings and help align the top casing to with bottom while attaching the top casing the bottom casing. In FIG. 16A there are two center raised portions 1644*a* and *b* and two center recessed portions 1642*a* and *b*. The center raised 1642*a* and *b* and center recessed portions 1644*a* and *b* on the center of FIG. 16A can mate with the center recessed and raised portions on the center of FIG. 16B. However, in an embodiment, for example, the top casing may have four raised portions (where center raised 1642*a* and *b* and center recessed portions 1644*a* and *b* are currently located) and the bottom casing may have four recessed portions that mate with the four recessed portions (or vice versa).

Center of casing 1675 is the portion of top casing 1600*a* where left head 1621 and right head 1622 meet. Center of casing 1675 supports recessed portions 1642*a* and has raised portions 1644*a* and *b*.

The body of the knife has two halves (top casing 1600*a* (FIG. 16A) and bottom casing) 1600*b* (FIG. 16B) that fit together to form the body of the knife over which the sliding sleeve is placed. The two blades (see 1210 in FIG. 12) are sandwiched between the two halves of the body of the knife (1600*a* and 1600*b*). The two blades are held in wells 1631*a* and *b* in the body of the knife each having a raised blade fitting 1632*a* and *b* in the middle for orienting the blade and holding the blade in place. In an embodiment, all of the protrusions and the recesses of one head are mirror patterns of one another.

FIG. 16B is the bottom half of the casing. In FIG. 16B the slotted blade recesses 1635*a* and *b* are recessed portions that engage the complementary raised portions (raised blade fitting 1632*a* and *b*) on the other inside of the casing (FIG. 16A). FIG. 16B has protrusions (raised portions) and recessed portions (or wells or indentations) that are complementary to, and fit into, the corresponding set of recessed portions (or wells or indentations) and protrusions in the top half of the knife 1600*a*, which is shown in FIG. 16A. The complementary protrusions and recessed portions engage one another and hold the two halves of the knife together. In an embodiment the two halves of the body of the knife are identical. For example, the two halves of the knife may be adhered together by placing melted plastic between the two halves of the body of the knife, which cools and solidifies to hold the two halves together.

Figure 17A:
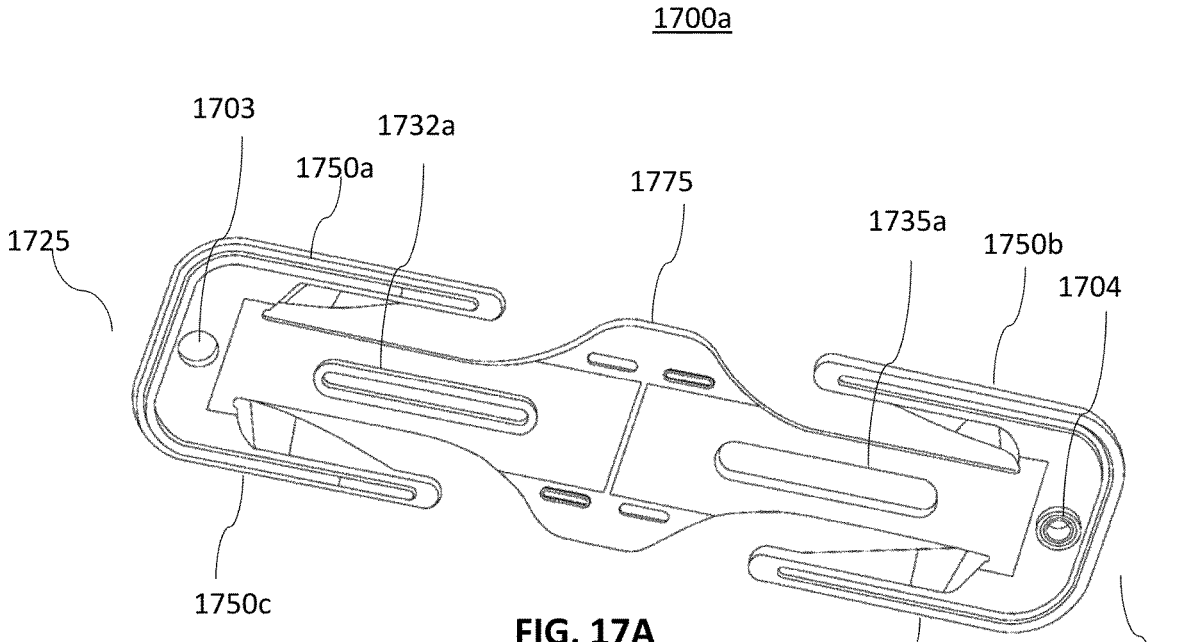
FIGS. 17A and 17B shows an illustration of an embodiment of the inner side of the two halves of the knife casing with opposite protrusions compared to FIG. 16.
Figure 17B:
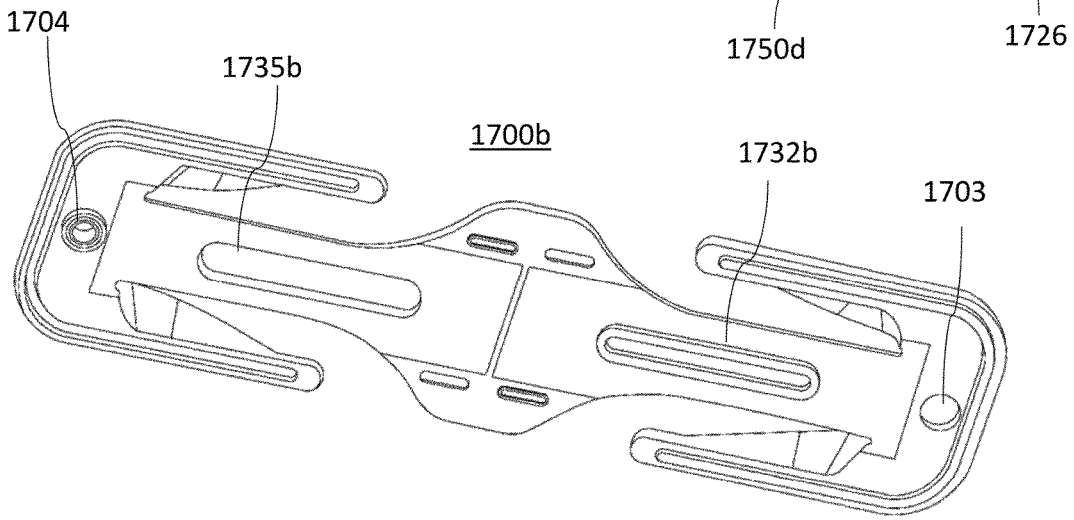

FIGS. 17A and 17B are further embodiments of the inside of the top and bottom casing of a double headed knife (1700*a* is the top and 1700*b* is the bottom). In FIG. 17A, the inner side of the top casing of the double headed knife 1700*a* may include circular recessed portion 1703, circular raised portion 1704, heads 1725 and 1726, wells 1731*a* and 1731*b*, raised blade fitting 1732*a*, slotted blade recess 1735*a*, arms 1750*a-d* and center of casing 1775. In other embodiments 1700*a* may not have all of the elements or features listed and/or may have other elements or features instead of or in addition to those listed.

In FIG. 17B, the inner side of the bottom casing of the double headed knife 1700*b* may include circular recessed portion 1703, circular raised portion 1704, raised blade fitting 1732*b*, and slotted blade recess 1735*b*. In other embodiments 1700*a* may not have all of the elements or features listed and/or may have other elements or features instead of or in addition to those listed.

Circular recessed portion 1703 and circular raised portion 1704 are embodiments of circular raised portion 1603 and circular raised portion 1604 in FIG. 16A. However, in some embodiments, two circular recessed portions 1703 may be on one side of the casing (e.g., the top 1700*a*) and two circular raised portions 1704 may be on the other side of the casing (e.g., the bottom 1700*b*).

Heads 1725 and 1726, wells 1731*a* and 1731*b*, arms 1750*a-d* and center of casing 1775 are embodiments of heads 1625 and 1626, wells 1631*a* and 1631*b*, arms 1650*a-d* and center of casing 1675 of FIG. 16.

FIG. 17A is the same as FIG. 16A except one of the raised blade fittings is replaced with a slotted blade recess. Thus, FIG. 17A has one raised blade fitting 1732*a* and one slotted blade recess 1735*a*.

FIG. 17B is also the same as FIG. 16B except one of the raised blade fittings is replaced with a slotted blade recess. Thus, FIG. 17B has one raised blade fitting 1732*b* and one slotted blade recess 1735*b*.

The top casing shown in FIG. 17A and the bottom casing shown in FIG. 17B are actually the same. The only difference between the casing shown in FIG. 17A and the casing shown in FIG. 17B is the orientation of the entire casing. Thus, FIGS. 17A and 17B show two different copies of the same part (the casing) to illustrate an embodiment in which a second copy of the casing (FIG. 17B) can be oriented so as to mate with the first copy of the casing (FIG. 17A), and thus only one mold is necessary for making both halves of the casing, because in the embodiment of FIGS. 17A and 17B both halves are identical. Thus, each half of the casing of 17A and 17B has one raised blade fitting 1732 and one slotted blade recess 1735. The raised blade fitting 1732 of each half fits into the slotted blade recess 1735 of the other portion.

In the embodiments of FIGS. 16A, 16B, 17A, and 17B, the top half of the casing (FIGS. 16A and 17A) may be glued to, and/or welded to, the bottom half of the casing (16B and 17B).

Figure 18A:
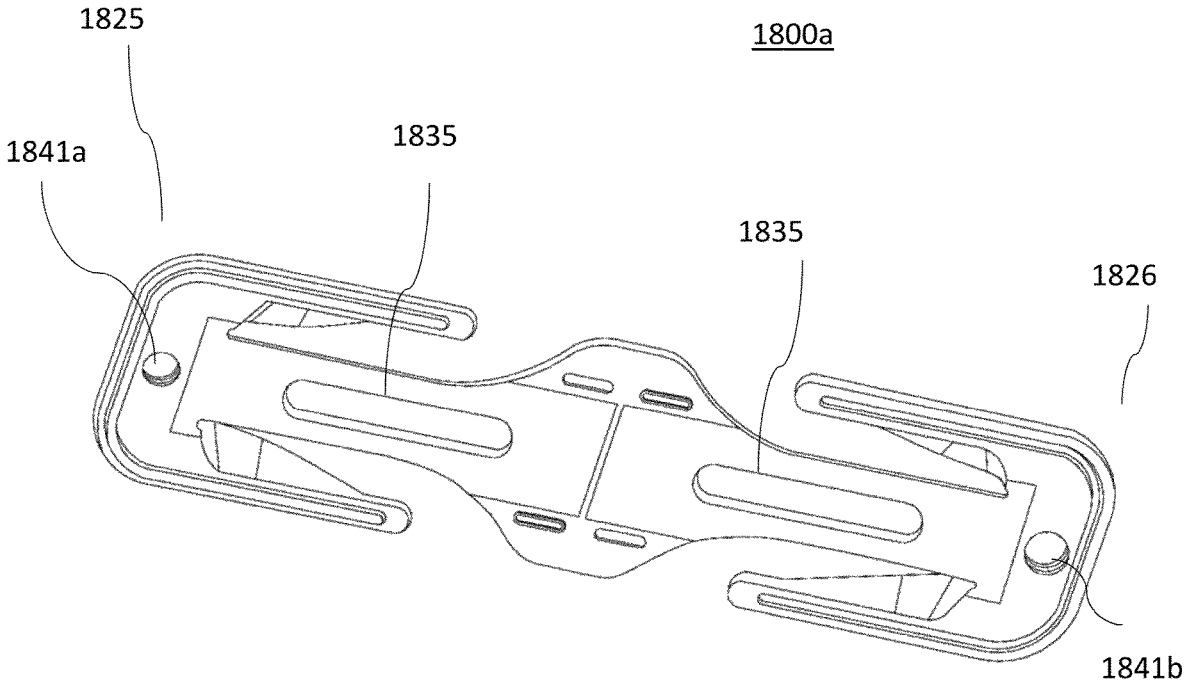
FIGS. 18A and 18B show an inner side of the top and bottom casing of an embodiment of a knife with the blade removed.
Figure 18B:
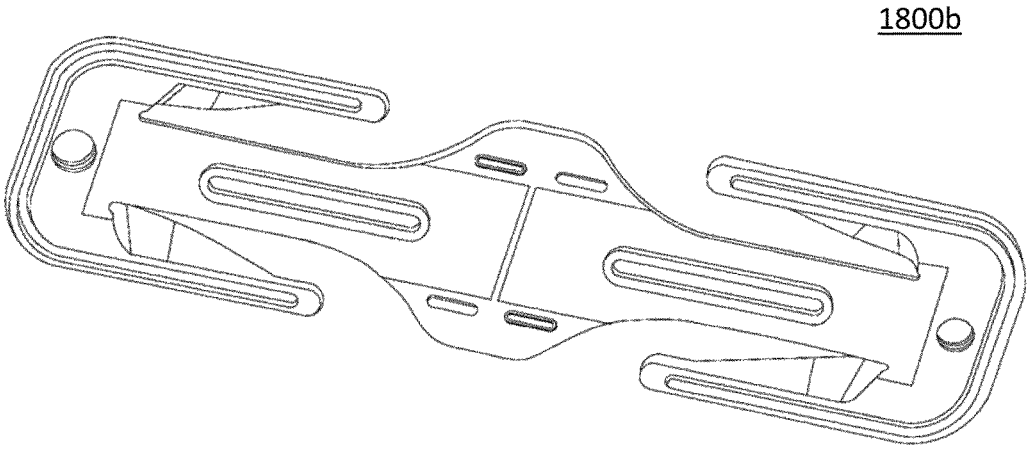

FIG. 18A shows an inner side of the top half of an embodiment of the knife with the blade removed. FIG. 18B shows the inner side of the bottom half of an embodiment of the knife with the blade removed. The top casing 1800*a* may include head 1825 and 1826, fastener holes 1841*a* and *b* for fasteners, and arm(s) 1850*a-d*. In other embodiments 1800*a* may not have all of the elements or features listed and/or may have other elements or features instead of or in addition to those listed.

Heads 1825 and 1826 are similar to left head 1625 and right head 1626 of FIG. 16A except that holes for fasteners are located where the circular protrusions and circular recesses of FIGS. 16 A and B were located.

Top casing 1800*a* is the same as the top casing 1600*a* of FIG. 16A except that top casing 1800*a* has fastener holes 1841*a* and *b* for fasteners. The fasteners can be any type of fastener discussed herein. For example, fastener holes 1841*a* and *b* may be screw holes and the inside of the screw hole may include corresponding internal threads complementary to threads on the screw. Alternatively, a bolt may be used to hold the screw in the fastener holes 1841*a* and *b*. Bottom casing 1800*b* (FIG. 18B) is the same as the bottom casing

1600*b* of FIG. 16B except that bottom casing 1800*b* has fastener holes for fasteners that are similar or identical to those in FIG. 18A. The fastener holes function to removably attach the top casing 1800*a* to the bottom casing 1800*b*.

Figure 19:
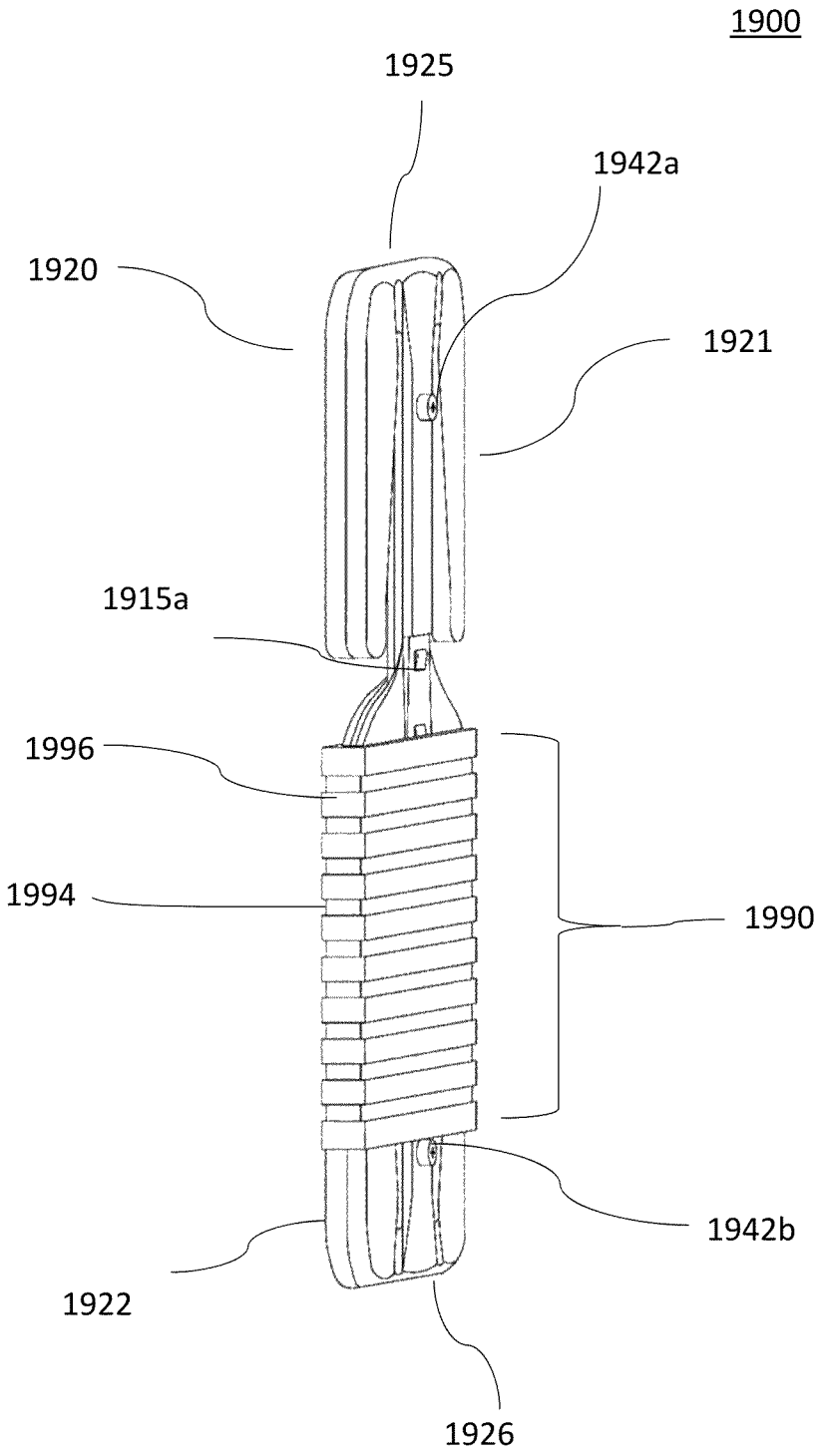
FIG. 19 shows a perspective view of an embodiment of a double headed knife, in which the top of the top casing and the side of the knife are most prominently visible.

FIG. 19 shows an example of a top front perspective view of an embodiment of a double headed knife 1900. Knife 1900 is the knife of FIGS. 18A and 18B after being assembled with a screw. Knife 1900 includes a casing 1920. Casing 1920 includes a top half 1921 and a bottom half 1922. Knife 1900 also includes left protrusion 1915*a*, heads 1925 and 1926, screws 1942*a* and *b*, arms 1950*a* and *b*, and sliding sleeve 1990 having channels 1994 and bands 1996. Other embodiments of single-side knife 1900 may not have all of the components and/or may have other embodiments in addition to or instead of the components listed above.

Knife 1900 is double sided, having two heads—one on each end of the knife. Left protrusion 1915*a* is an embodiment of left outer protrusion 1515*a*. Casing 1920 may be made of any plastic polymeric material. In alternative embodiments, casing 1920 may be made of other materials, such as other plastics, wood, metals, or ceramics. Any place is the specification where plastic is mentioned, Kevlar®, wood, ceramic, or another material may be substituted.

Top half 1921 and bottom half 1922 are sandwiched together and secured in place by a fastener, such as screw, bolt, rivet, clasp of other fastener. Top half of casing 1921, bottom half of casing 1922, heads 1925 and 1926, arm(s) 1950*a* and *b*, and sliding sleeve 1990 having channels 1994 and bands 1996 are embodiments of top casing 1221, bottom casing 1222, left head 1225, right head 1226, arms 1250*a* and *b*, and sliding sleeve 1290 having channels 1294 and bands 1296 in FIG. 12.

Screws 1942*a* and *b* hold top casing 1921 of casing 1920 and bottom casing 1922 of casing 1920 together. In an embodiment, screws 1942*a* and be are held in place by nuts on the other side of the casing. The screw heads of screws 1942*a* and *b* are not flush with the surface of the casing, but the screw heads protrude upwards above the surface of the top casing 1921. The screw heads protrude upwards above the surface of the top casing 1921 to such a height that the sliding sleeve is prevented from sliding off the knife, despite the flexibility of the sliding sleeve.

The nuts and/or screws 1942*a* and *b* are all made from 316ss grade stainless steel, or another corrosion resistant alloy that can withstand prolonged exposure to salt and water without corroding. In an embodiment the nuts are hexagonally shaped or another noncircular shape. In an alternative embodiment, screws 1942*a* and *b* have hexagonal shaped heads (or other noncircular shaped heads). However, in another embodiment screws 1942*a* and *b* and/or nuts can be made of another material, such as a strong and durable plastic or another grade of metal. One socket or fastener hole per screw (such as that shown in FIGS. 18A and 18B) may be noncircular and may mates with the nut or screw head, so that screws 1942*a* and *b* may be screwed into nut while socket prevents nut from turning or the nuts may be screwed onto the screws while the noncircular socket prevents the noncircular screw head from turning. Optional covers may be placed over the screws 1942*a* and *b* (or another fastener) to cover and protect the screws. Once the nut is placed in a fastener hole (such as that shown in FIGS. 18A and 18B), an optional cover 1948 may hide the nut from view. There may be a similar cover covering each of the socket for screws and nuts of each the embodiments of the knives in this specification. In this embodiment, the screw heads 1942*a* and *b* are tall enough to prevent the sliding sleeve 1990 from being removed without first removing one or both screws 1942*a* and *b*. In other words, before the screws 1942*a* and *b* are inserted the sliding sleeve 1990 is put on the knife, and then the screws 1942*a* and *b* are inserted to keep the sliding sleeve from coming off the knife. Optionally, the nuts may protrude from the knife to prevent the sliding sleeve from sliding off the knife.

Figure 20A:
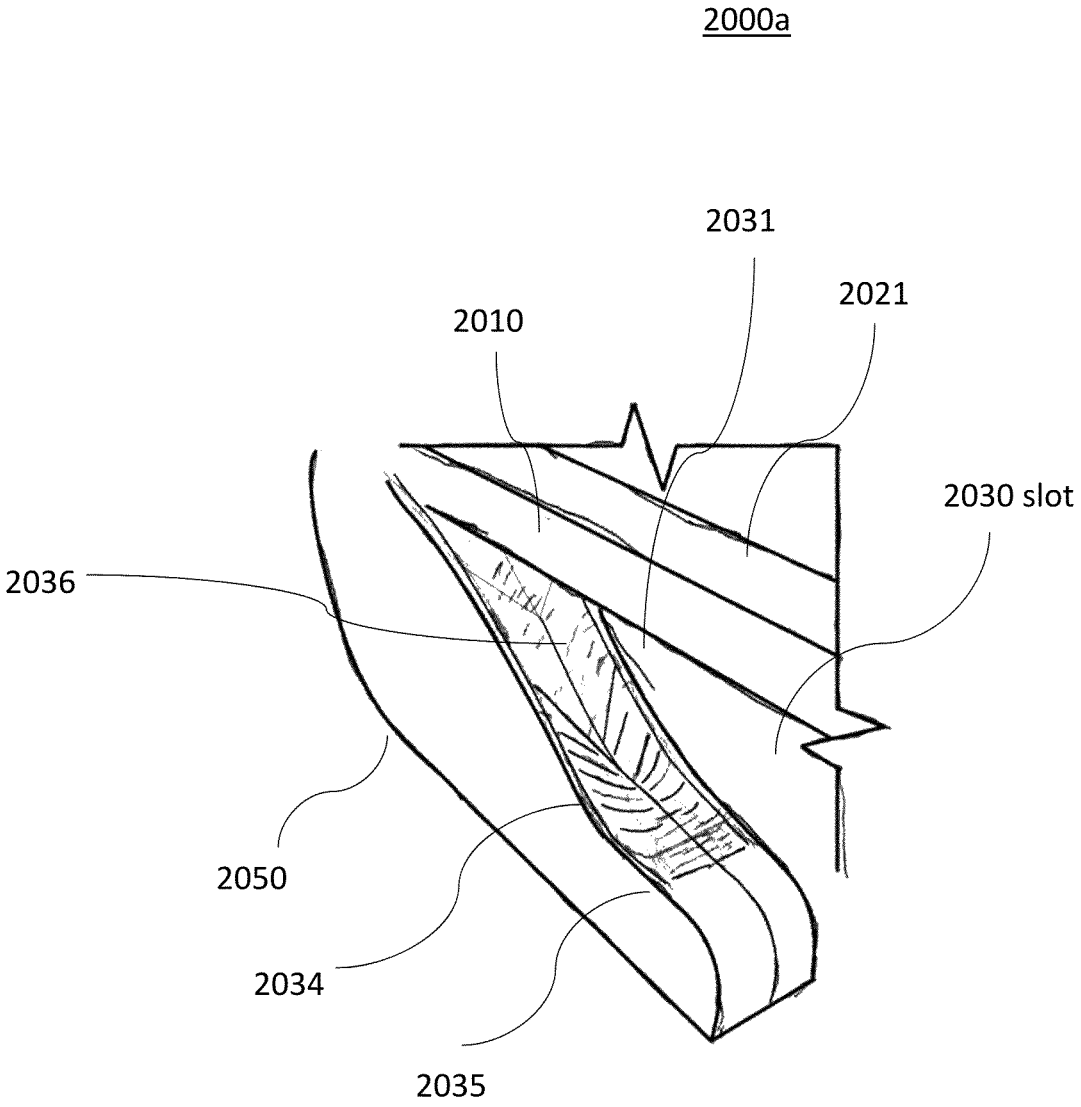
FIG. 20A shows a partial perspective view of an embodiment of a slot of a double headed knife.

FIG. 20A is a perspective drawing illustrating an embodiment of the slot 2000*a* produced by arms and casing on any of the double headed knives discussed herein. The arms 2050 are shaped to help movement of a line or rope into the groove with the blade. The slot 2000 may include top of casing 2021, blade 2010, slot 2030, arm 2050 having groove 2031, trough 2034, flat bottom 2035 and v-shaped portion 2036. In other embodiments slot 2000*a* may not have all of the elements or features listed and/or may have other elements or features instead of or in addition to those listed.

The top of casing 2021, arm 2050, blade 2010, slot 2030, and the groove 2031 are embodiments of top of casing 1221, arm 1250, blade 1210, slot 1230, and groove 1231 in FIG. 12.

The arm 2050 has a shape that helps to move the line into the groove 2031 containing the blade 2010.

Trough 2034 is located in the arm of the knife at one side of slot 2030. The directing edge of the arm is the tope edges of the walls of the trough 2034. The cutting edge of the blade 12010 faces a trough 2034. Trough 2034 has one portion with a flat bottom and another portion with a v-shaped bottom.

Flat bottom 2035 is the portion of the bottom of trough 2034 that is flat. Flat bottom 2035 is at the entrance of the trough 2034, the part of the trough that is closest to the opening of slot 2030.

V-shaped bottom 2036 is the portion of the bottom of trough 2034 that is V-shaped. There is a gradual transition between the flat bottom 2035 and the v-shaped bottom 2036. As a line travels along the trough 2034, the trough gradually narrows until for the last section of the trough, which is about ⅕th of the length of the trough 2034, there is a v-shaped bottom 2036, where a cross-sectional of the trough has an apex that has a V shape. The gradual change form a flat bottom to a v-shaped bottom along with the bulge in the directing edge of arm 1250 may assist in bring the line into the groove 2031 while gradually encountering and being pushed into the blade 2010.

Figure 20B:
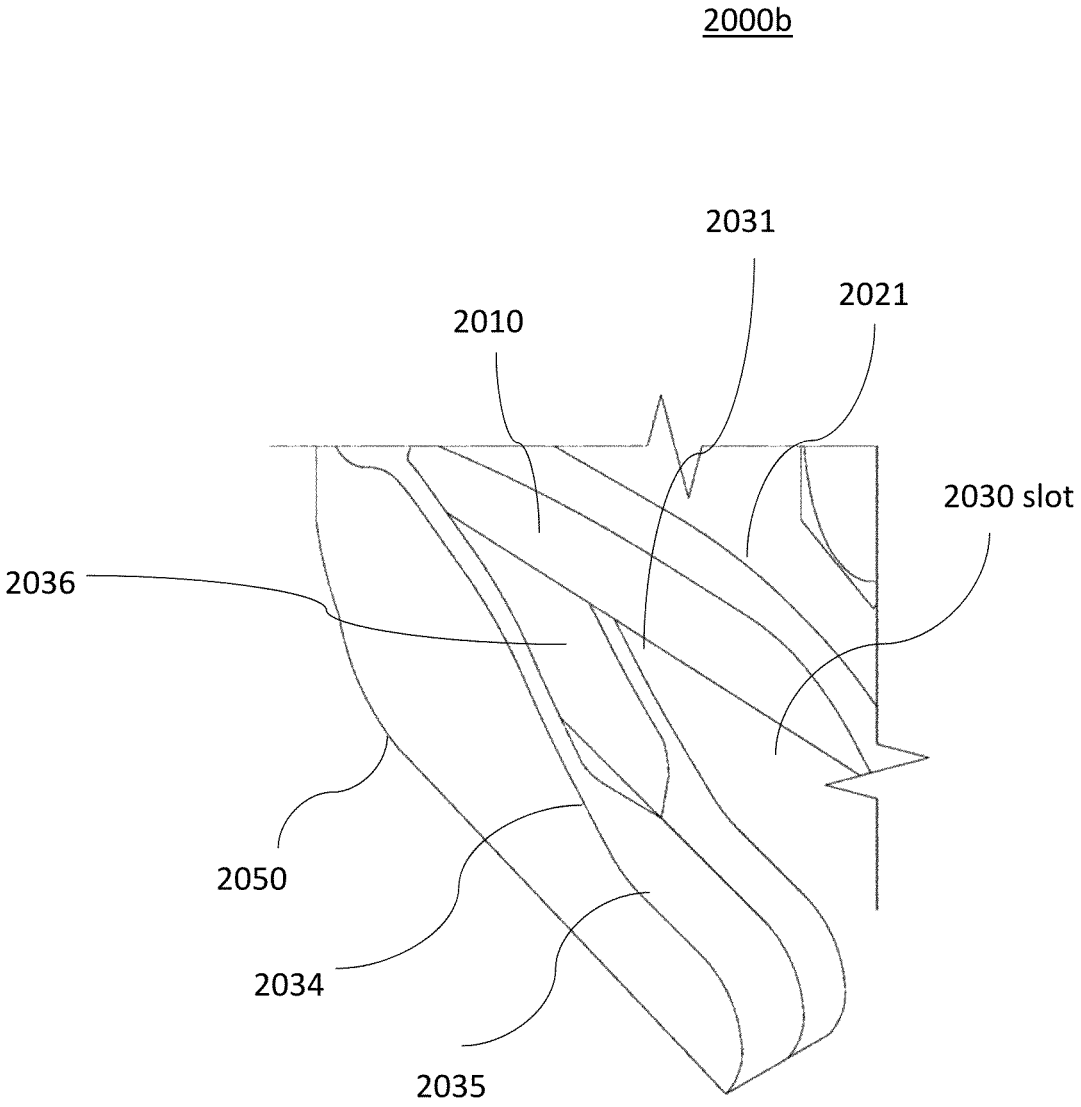
FIG. 20B shows a partial perspective view of an embodiment of a slot of a double headed knife.
Figure 20C:
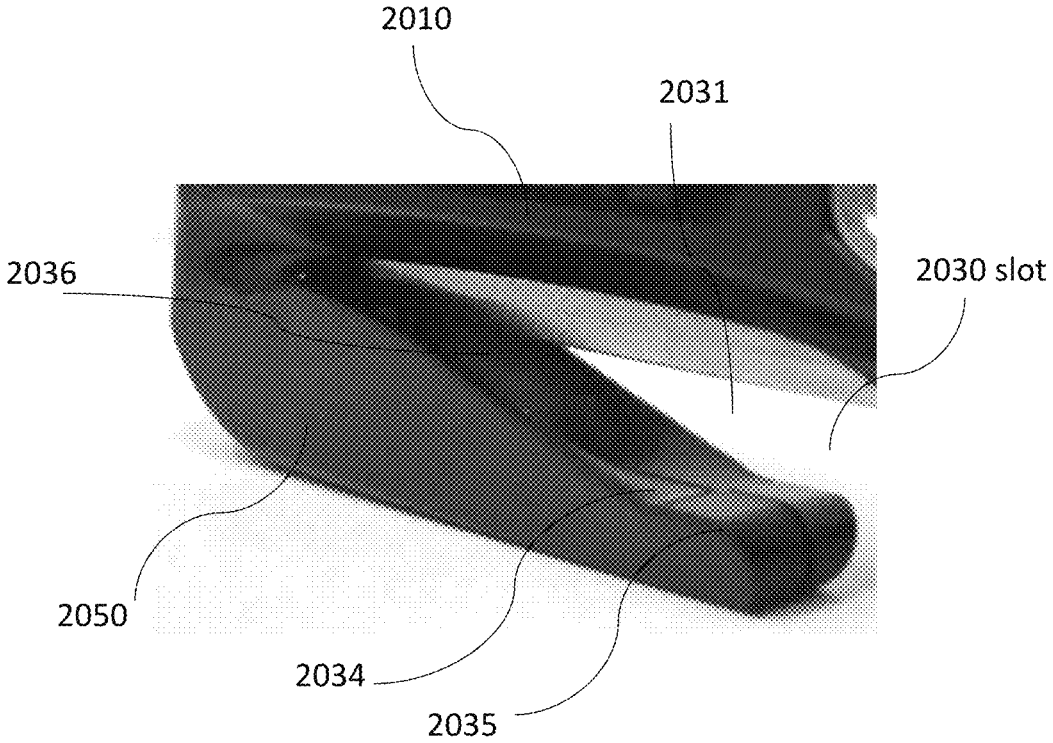
FIG. 20C shows a partial perspective view of an embodiment of a slot of a double headed knife.

FIGS. 20B and 20C show the elements mentioned above in the discussion of FIG. 20A.

Figure 21:
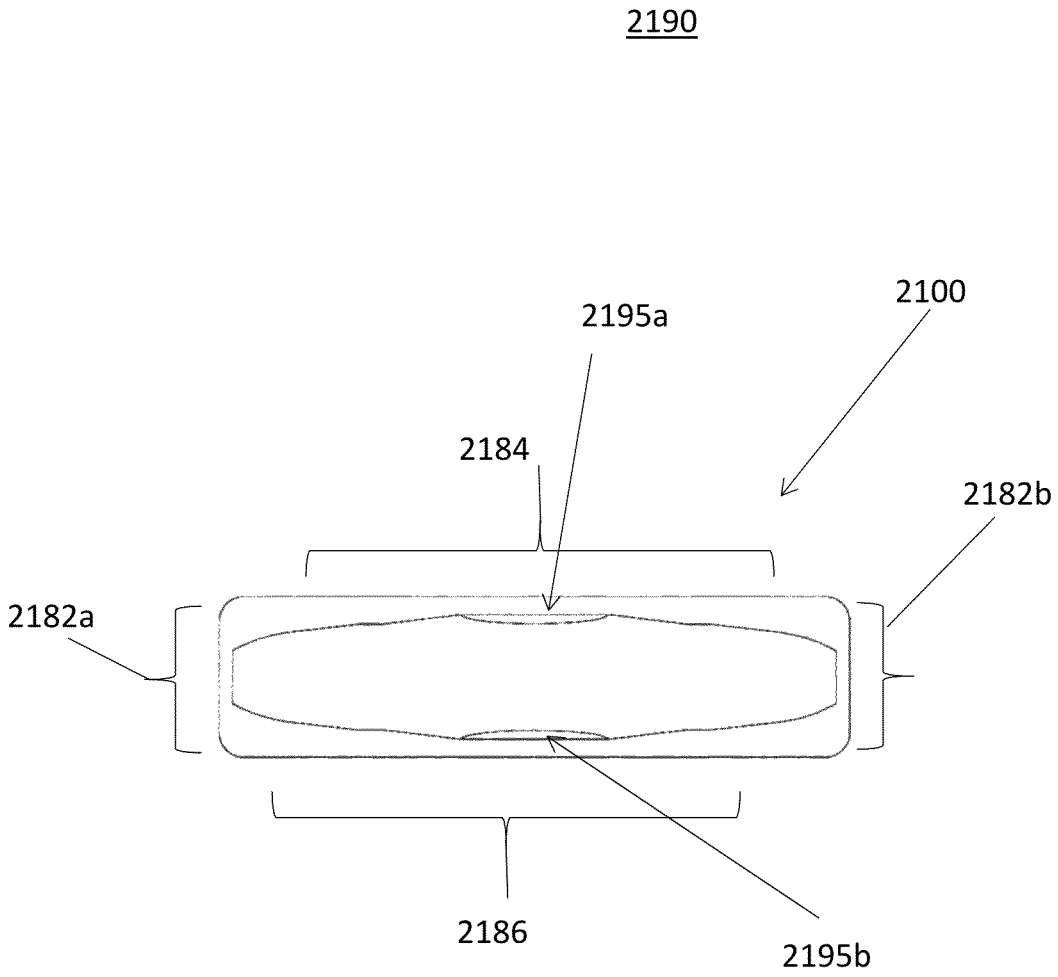
FIG. 21 is a drawing illustrating an embodiment of a front view of the sliding sleeve on any of the double headed knives discussed herein.

FIG. 21 is a representation of a front view of an embodiment of the sliding sleeve 2100, which may be placed upon and/or used with any of the double headed knives discussed herein. The sliding sleeve 2100 may include two sides 2182*a* and *b*, a top 2184, a bottom 2186, and two protrusions 2195*a* and *b*. In other embodiments sliding sleeve 2100 may not have all of the elements or features listed and/or may have other elements or features instead of or in addition to those listed.

Sliding sleeve 2100 is an embodiment of sliding sleeve 1290 or 1590. The sliding sleeve 2100 functions to cover one or both blades on the double headed knife. Sliding sleeve 2100 is made from a rigid, but resilient material (e.g., Kevlar®), so that as the protrusion on the inside of the sliding sleeve 2100 slide over the protrusion on the surface of the knife, the sliding sleeve flexes as the protrusions on the inside of sliding sleeve 2100 is raised off the surface of the knife by the protrusions on the knife to allow the sliding sleeve to pass the protrusions. The sliding sleeve 2100 may include two protrusions. Sliding sleeve 2100 is an embodiments of sliding sleeve 1590, which was discussed in conjunction with FIG. 15. Two sides 2182*a* and *b* are the two sides of the sliding sleeve 2100. Top 2184 is the top of the sliding sleeve. Bottom 2186 is the bottom of sliding sleeve 2100. Sides 2182*a* and *b* are the sides of the sliding sleeve 2100.

Protrusion(s) 2195*a* and *b* are embodiments of protrusions 1595 which was discussed in conjunction with FIG. 15. Protrusions 2195*a* and *b* are the protrusions on the inside cover of sliding sleeve 2100, which slide over the protrusion on the cover of the knife. Protrusions 2195 may be semi-cylindrical in shape and may be located on the inside of sliding sleeve 2100, on the top 2184 and bottom 2186 of sliding sleeve 2100.

The sliding sleeve 2100 is constructed with two sides 2182*a* and *b*, a top 2184, and a bottom 2186. Sliding sleeve 2100 slides onto the double headed knife in such a way that the protrusion(s) 2195*a* and *b* can be pushed over the protrusions on the casing of the double headed knife (see, for example, FIG. 15A, 1515*a*, 1515*b*, 1516*a*, and 1516*b*). The sliding sleeve 2100 may have one or two protrusions 2195*a* and *b* that are bumps with a semi cylindrical shape in the center of the bottom of the sliding sleeve. The protrusions on the sliding sleeve 2195 *a* and *b* come in contact with, and fit between, protrusions on the top of the casing of the double headed knife (see for example FIG. 15A, 1515*a*, 1515*b*, 1516*a* and 1516*b* for examples of protrusions on the top of the casing of the double headed knife). The purpose of the sliding sleeve protrusion(s) 2195 *a* and *b* is to hold the sliding sleeve in a position in the middle, on the left or on the right end of the double headed knife such that the blades are covered (see, for example, FIGS. 12-14).

Protrusions 2195*a* and *b* causing top 2184 and bottom 2186 to flex into and acquire a bow-like shape or at least to have more of a bow-like shape than when protrusion 2195*a* and *b* are between the protrusions on the surface of the knife.

Figure 22:
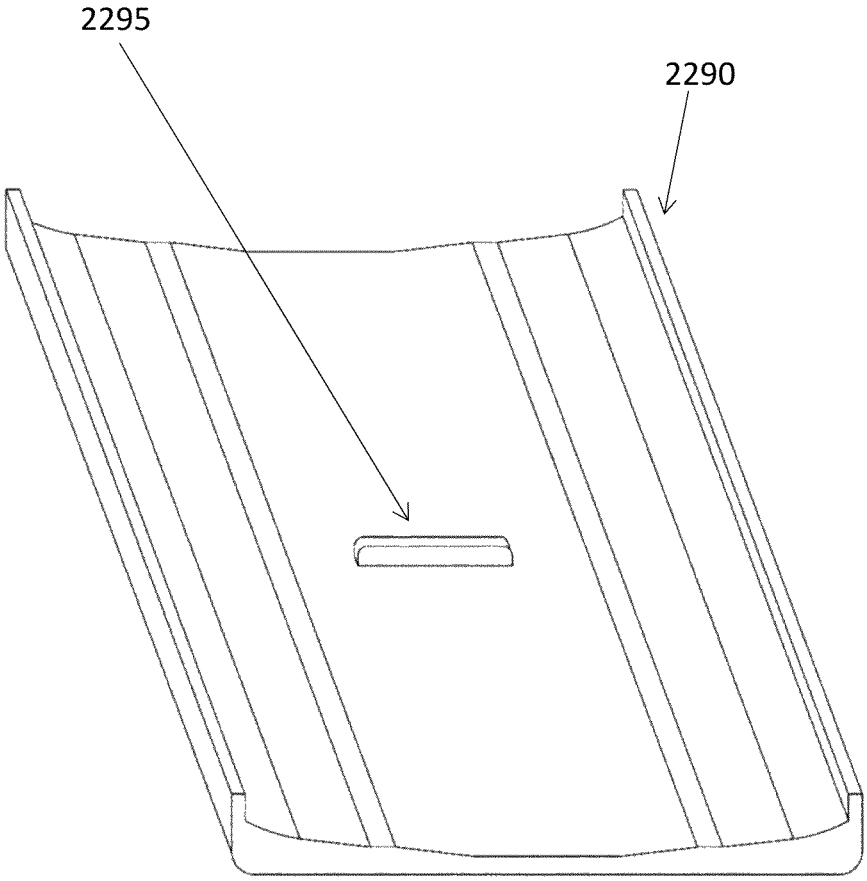
FIG. 22 shows an embodiment of the inside of the bottom or top of a sliding sleeve for a double headed knife.

FIG. 22 shows an embodiment of the inside of the bottom or top of a sliding sleeve 2290 for a double headed knife. The sliding sleeve 2290 may include a protrusion 2295. In other embodiments sliding sleeve 2290 may not have all of the elements or features listed and/or may have other elements or features instead of or in addition to those listed.

The inside of the sliding sleeve 2290 may include a protrusion 2295 which is a central protrusion and is shown as a thin semi cylindrical protrusion. This protrusion 2295 can be any shape that can fit over the protrusions (see FIGS. 16, 1615*a*, 1615*b*, 1616*a*, and 1616*b*) on the top casing of the double sided knife. The protrusion can be any shape that can fit between the central protrusions on the casing (see FIGS. 16, 1616*a* and *b*). The protrusion 2295 can be on the inside top of the sliding sleeve 2290, on the inside bottom or on both the top and bottom (as shown in FIG. 21).

Method of Use

Figure 23:
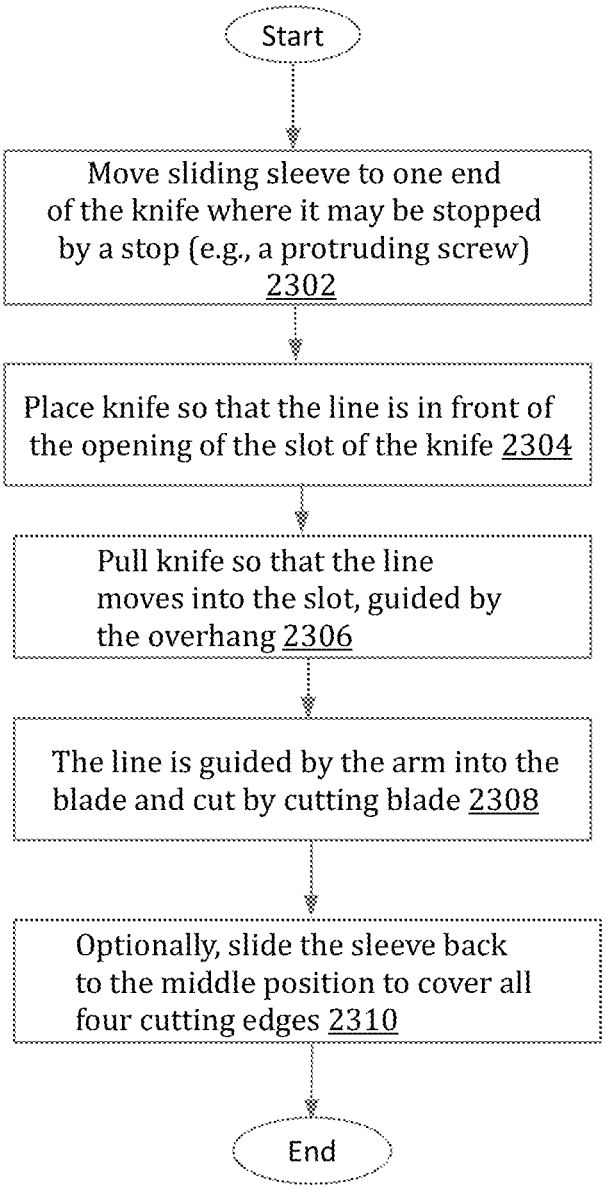
FIG. 23 shows a flowchart of an embodiment of a method for using a double headed knife to cut a line.

FIG. 23 shows a flowchart of an embodiment of method 2300 for using a double headed knife to cut a line.

In step 2302, the user moves the sliding sleeve to one end of the knife where the sliding sleeve may be stopped by a stop that is opposite the steep face of an outside protrusion. The movement of the sleeve uncovers one of the heads containing a blade. In an embodiment, the sleeve can be moved until the sliding sleeve is held in place by one of the outer protrusions (see FIG. 15A, 1515*a*, or 1515*b*). A protrusion connected to the sliding sleeve (see FIG. 15B, 1595) will be caught between a stop and an outer protrusion at the right edge or left edge (see FIG. 19, 1940). In a further embodiment, a specific stop, such as a protruding screw and/or nut can be included at either or both ends and/or sides to ensure that the sliding sleeve does not come off of the double headed knife.

In step 2304, the knife is placed by the user so that the line is in an opening or in the slot of the knife. A user places the line in the opening of the knife in the slot (see FIG. 12, 1230) formed by the arm and the body of the knife. The arm has a directing edge, which may have a convex shape that moves the line into the groove. In an embodiment, the cutting blade is double-sided and the head has two arms having directing edges for each blade. In some embodiments, a line that can fit within the opening (see FIG. 15A, 1538) (the opening is the one that is analogous to opening 190 of FIG. 1) and/or into the groove can be cut by the double headed knife. In step 2306, the user pulls the knife so that the line moves into the slot, guided by the overhang. The user pulls the knife in a direction such that the cord position changes relative to the knife. The movement of the knife causes the cord to slide within the slot in a direction parallel to the blade and in a direction such that the line's position (relative to the knife) becomes closer to the point where the arm meets the body of the knife. The directing edge directs the line into the blade of the knife. Optionally, to the extent that the blade does not immediately begin to cut into the line, the line is pinched by the groove.

In step 2308, the line is cut by the cutting blade. As discussed previously, the size and type of rope, cord or string that can be cut by the double headed knife, depends upon the material the line is produced from. For example, in an embodiment in which the opening of the slot is only 4.5 mm (the perpendicular distance from the inner edge of the overhang to the blade), the knife easily cut a 9 mm diameter cord.

In step 2310, the user can optionally slide the sleeve back to the middle position to cover all four cutting edges. In one embodiment, the protrusion on the sliding sleeve can be pushed over one of the center protrusions (see 1516 in FIG. 15) on the casing to be held between the two center protrusions, holding the sliding sleeve in place and covering both sides of the double headed knife and all of the knife blades.

In an embodiment, each of the steps of method 2300 is a distinct step. In another embodiment, although depicted as distinct steps in FIG. 23, step 2302-2310 may not be distinct steps. In other embodiments, method 2300 may not have all of the above steps and/or may have other steps in addition to or instead of those listed above. The steps of method 2300 may be performed in another order. Subsets of the steps listed above as part of method 2300 may be used to form their own method.

Method for Changing the Blade

Figure 24:
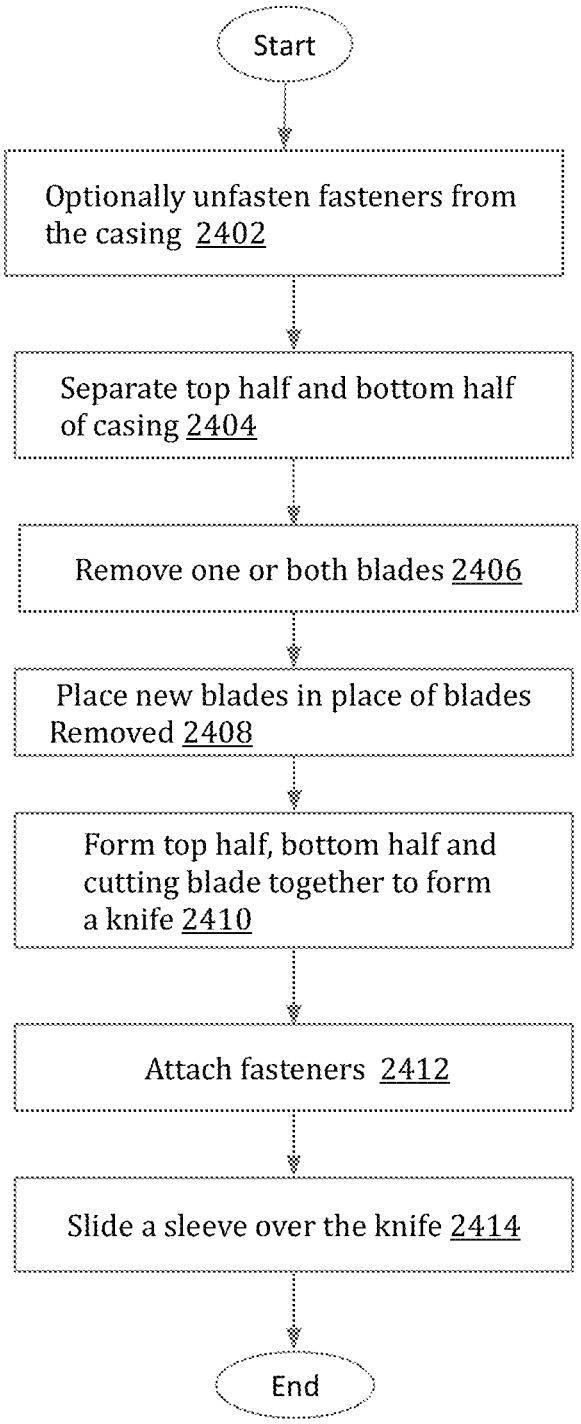
FIG. 24 shows a flowchart of an embodiment of a method for changing the blade in a double headed knife.

FIG. 24 shows a flowchart of an embodiment of method 2400 for changing the blade in the double headed knife of FIGS. 18A and 18B.

In step 2402, the user of the knife optionally unfastens fasteners from the casing. An embodiment of the fasteners is shown in FIGS. 18A and 18B as a screw, which are removed in step 2402. In an embodiment there are only two fasteners. In another embodiment there are thee or fours screws, which are removed in step 2402. Optionally, two of the fasteners protrude from the surface of the knife. For example two of the screws have head and/or nuts that protrude from the surface of the knife. In embodiments in which the fastener keeps the sliding screw from sliding off the knife, the screws holding the sliding sleeve on the knife (which may be the only fasteners) are removed before the sliding sleeve may be removed and finally the other fastener(s) (e.g. the other screw or screws) may be removed. In other words, if one of the screws functions to hold the sliding sleeve on, that screw may be removed first in order to remove the sliding sleeve to make the other screw or screws easier to access.

In step 2404, the user separates the top half and bottom half of the casing of the double headed knife (see FIG. 2B as an example using the single headed knife).

In step 2406, the user removes one or both blades. The blades are held in place by the raised portions in the center of the inside of the casing (see FIG. 16, 1632). The blades have a central hole that fits around and over the raised portions to fit within a recess for holding the blade (see well FIG. 16, 1631). The blade or blades may be lifted out.

In step 2408, the user places new blades in place of the blade or blades that were removed. The new blade or blades can be set back into the recess or well, which may include a placing a raised fitting that is in the well through a slot of the blade. Alternatively, if only one side of the blade is typically used, the user may choose to turn the blade so that the dull edge is situated on the side that the user typically does not use. In other words, there may be two razor blades—each razor blade is double-bladed (for a total of 4 cutting edges). So the user may take the knife apart and rather than replace both blades, turn one or both blades so that the sharp edge is in a more useful position.

In step 2410, the user attaches the top half of the casing to the bottom half of the casing to form a knife. Once the blade is inserted into the well in step 2408, the top and bottom half of the casing fit together. The two parts of the casing can be fit together by pushing raised portions on one side into recessed portions on the other side (see FIGS. 17-20 for the end, arm and center raised and recessed portions: 1603, 1606, 1644). The complementary protrusions and recessed portions engage one another and hold the two halves of the knife together.

In step 2412, the user fastens the top half, bottom half and cutting blade together. In some embodiments, the fastener is a screw (see FIG. 18). Optionally, one or more of the fasteners that do not interfere with the movement of the sliding sleeve (if there are any such fasteners) are attached to hold the top half, bottom half, and blade together.

In step 2414, the user slides a sliding sleeve over the knife. The sliding sleeve is discussed in the method of FIG. 2300 (see 2302). Optionally, one or more fasteners may be attached after the sliding sleeve is placed on the knife and may function to keep the sliding sleeve from falling off of the knife and may additionally keep the two halves of the casing together.

In an embodiment, each of the steps of method 2400 is a distinct step. In another embodiment, although depicted as distinct steps in FIG. 24, step 2402-2414 may not be distinct steps. In other embodiments, method 2400 may not have all of the above steps and/or may have other steps in addition to or instead of those listed above. The steps of method 2400 may be performed in another order. Subsets of the steps listed above as part of method 2400 may be used to form their own method.

Method for Making the Double Headed Knife

Figure 25:
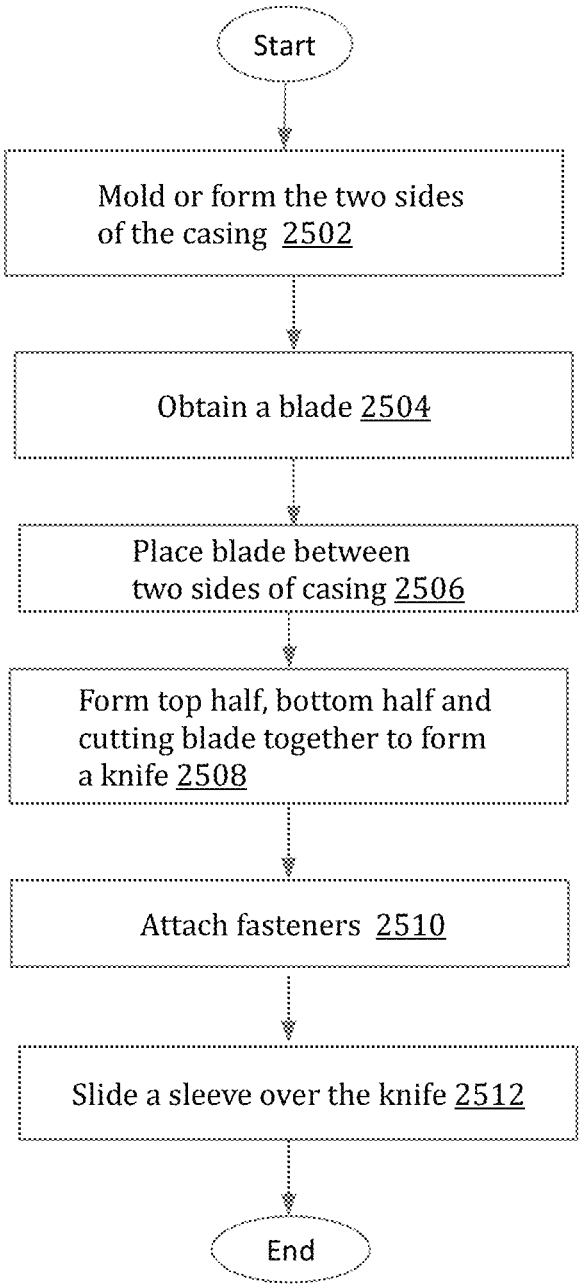
FIG. 25 shows a flowchart of an embodiment of a method for making a double headed knife.

FIG. 25 shows a flowchart of an embodiment of method 2500 for making the double headed knife of FIGS. 16A and 16B, 17A and 17B and 18A and 18B. The method of making the double headed knife may be the similar to the method used in reference to FIG. 4, with the exception that the double headed knife has no handle, and includes a sliding sleeve that is placed on the knife, and has 2 heads. Also, in some embodiments of the knife there are not fasteners, but an adhesive or welding are used instead to hold the two halves of the knife together.

In step 2502, a two-sided casing is formed for the double headed knife. In FIG. 16, the two halves of the casing are molded separately, in different molds, because each half of the casing is different from the other half of the casing. For example, the slotted aperture is molded on one side (the top or bottom of the casing) and the center protrusion for the slotted aperture is molded on the other side of the casing (the top or bottom) for the double headed knife of FIG. 16. Whereas for FIG. 17, the two sides of the casing are the same. Thus, for the double headed knife of FIG. 17, making the two sides of the casing would only require one mold.

In step 2504, a blade is obtained and/or formed. The blade may be any blade discussed herein. The blade may be chosen based on the type of usage the double headed knife may be envisioned for. The blades can be set back into the recess. Two double edged blades may be used. Optionally four single edged blades may be used. Typically, the double headed knife may be double bladed (for a total of 4 cutting edges).

In step 2506, the blade may be inserted into the recess in the center of one of the halves of the casing.

In step 2508, the two sides of the casing are placed together by inserting the protrusions into the recesses to form a knife. Once the blade is inserted into the recess in step 2408, the top and bottom half of the casing fit together. The two parts of the casing can be fit together by pushing raised portions on one side into recessed portions on the other side (see FIGS. 17-20 for the end, arm and center raised and recessed portions: 1603, 1606, 1644). The complementary protrusions and recessed portions engage one another and hold the two halves of the knife together. Optionally, as part of step 2508, the two halves are glued, welded, and/or otherwise caused to adhere together.

In step 2510, optionally, if there are any fasteners that a fastener is attached. In some embodiments, the two casings are welded together or glued together. Thus, the glue may be applied before the two sides of the casing are placed together using the protrusions and recessions to form the knife (step 2508). Optionally, for example if welding or a comparable method is used to fasten the two casings together, the step of fastening may occur after step 2508 or during step 2508.

In the embodiment of method 2500, when making an embodiment of FIG. 18A in which the screw heads do not obstruct the movement of the sliding sleeve, the fastener may be attached after step 2508 by placing a screw or other device into the holes at the ends of the heads and tightening.

In step 2512 a sliding sleeve is placed over the knife. The sleeve may be placed on the knife before or after step 2510. The sliding sleeve is discussed in the method of FIG. 2300 (see 2302).

Optionally, in some embodiments of the double headed knife a sheath as shown in FIGS. 5 and 6 can be configured to hold any embodiment of the double headed knife shown in FIGS. 12-22.

In an embodiment, each of the steps of method 2500 is a distinct step. In another embodiment, although depicted as distinct steps in FIG. 25, step 2502-2512 may not be distinct steps. In other embodiments, method 2500 may not have all of the above steps and/or may have other steps in addition to or instead of those listed above. The steps of method 2500 may be performed in another order. Subsets of the steps listed above as part of method 2500 may be used to form their own method.

ALTERNATIVES AND EXTENSIONS

Each embodiment disclosed herein may be used or otherwise combined with any of the other embodiments disclosed. Any element of any embodiment may be used in any embodiment.

Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

What is claimed is:

1. A knife comprising:

a knife body adapted and configured to receive a blade having a straight cutting edge, the knife body having a head and a tail opposite of the head, the knife body having a side extending between the head and the tail, the side of the knife body having a slot with an opening extending through the side into the knife body, the slot defining an arm of the knife body, the blade being mountable with the knife body and stationary with respect to the arm such that: (i) the straight cutting edge of the blade is on a side of the slot opposite the arm, (ii) the arm is opposite the cutting edge of the blade and overhangs the blade, (iii) the arm has a directing edge opposing the cutting edge of the blade, and (iv) the directing edge has a region that is convex and angled toward the cutting edge of the blade;

wherein the convex and angled region of the directing edge is spaced from the opening; and wherein the knife body is configured such that when blade is mounted in the knife body, the straight cutting edge of the blade has a first region facing the overhanging arm and a second region extending beyond the overhanging arm so that the second region is exposed in the opening.

2. The knife of claim 1 wherein the slot defines a handle portion of the knife body spaced from the arm by the slot.

3. The knife of claim 2 wherein the handle portion partially obstructs the second region of the straight cutting edge of the blade.

4. The knife of claim 1 further comprising a hole formed in the head of the knife body, the hole receiving a strap coupled to the knife body.

5. The knife of claim 4 further comprising a sheath, the sheath having a hollow interior volume adapted and configured to receive at least a portion of the knife, the sheath having an outer surface, the outer surface of the sheath being adapted and configured to releasably attach to the strap coupled to the knife body.

6. The knife of claim 5 wherein the strap has one of hook and loop material and the sheath outer surface has the other of hook and loop material.

7. The knife of claim 5 wherein the sheath comprises at least one piece of material folded over to define at least in part the hollow interior volume of the sheath.

8. The knife of claim 1 wherein the overhang has an internal, v-shaped groove.

9. The knife of claim 1 wherein the arm has region that is straight relative to the straight cutting edge of the blade mounted in the knife body.

10. The knife of claim 1 wherein the slot extends toward the tail of the knife body.

11. The knife of claim 1 wherein the knife body has a second side extending between the head and the tail, the second side of the knife body has a slot extending through the second side into the knife body, the slot of the second side defines a second arm of the knife body, the knife body being configured such that when the blade is mounted in the knife body, the blade is stationary with respect to the second arm, the blade has a second straight cutting edge on a side of the second slot opposite the second arm, the second arm is opposite the second straight cutting edge of the blade and overhangs the blade, the second arm has a directing edge opposing the second straight cutting edge of the blade, the directing edge of the second arm has a region that is convex and angled toward the second straight cutting edge of the blade.

* * * * *